US008044299B2

(12) United States Patent
Weeks

(10) Patent No.: US 8,044,299 B2
(45) Date of Patent: Oct. 25, 2011

(54) PROTECTIVE DEVICE WITH TAMPER RESISTANT SHUTTERS

(75) Inventor: Richard Weeks, Little York, NY (US)

(73) Assignee: Pass & Seymour, Inc., Syracuse, NY (US)

( * ) Notice: Subject to any disclaimer, the term of this patent is extended or adjusted under 35 U.S.C. 154(b) by 207 days.

(21) Appl. No.: 12/483,585

(22) Filed: Jun. 12, 2009

(65) Prior Publication Data

US 2009/0311892 A1 Dec. 17, 2009

Related U.S. Application Data

(63) Continuation-in-part of application No. 11/933,928, filed on Nov. 1, 2007, now Pat. No. 7,642,457, which is a continuation of application No. 11/609,793, filed on Dec. 12, 2006, now Pat. No. 7,312,394, which is a continuation-in-part of application No. 10/900,778, filed on Jul. 28, 2004, now Pat. No. 7,179,992, which is a continuation-in-part of application No. 10/729,685, filed on Dec. 5, 2003, now Pat. No. 7,312,963.

(51) Int. Cl.
*H01R 13/46* (2006.01)

(52) U.S. Cl. ..... 174/53; 174/66; 439/107; 335/18; 361/42

(58) Field of Classification Search ..... 174/53, 174/58, 66, 135; 439/106, 107, 369; 361/42, 361/51; 335/18, 165, 176; 385/76, 92
See application file for complete search history.

(56) References Cited

U.S. PATENT DOCUMENTS 3,845,234 A 10/1974 Brenner
3,990,758 A 11/1976 Petterson
4,379,607 A 4/1983 Bowden, Jr.
4,484,021 A 11/1984 Schaefer et al.
4,529,834 A 7/1985 Nattal
4,544,219 A 10/1985 Barkas
4,567,544 A 1/1986 Ronemus et al.
4,688,134 A 8/1987 Freeman et al.
4,722,693 A 2/1988 Rose
4,749,360 A 6/1988 Dudley et al.
4,820,187 A 4/1989 May
4,822,290 A 4/1989 Cauley et al.
4,867,693 A 9/1989 Gizienski et al.
4,867,694 A 9/1989 Short
4,927,373 A 5/1990 Dickie
(Continued)

FOREIGN PATENT DOCUMENTS

WO 2004066327 A2 8/2004
(Continued)

*Primary Examiner* — Dhirubhai R Patel

(74) *Attorney, Agent, or Firm* — Daniel P. Malley; Bond Schoeneck & King

(57) ABSTRACT

The present invention is directed to a modular shutter assembly for use within various types of electrical wiring devices having differing amperage ratings. The modular shutter assembly includes a first shutter member having a first blade engagement structure. The first shutter member is configured to be disposed within an interior portion of the cover assembly and disposed between a set of receptacle openings and a set of receptacle contacts. A second shutter member includes a second blade engagement structure and is slidably disposed within the first shutter member. An interface is configured to connect a third shutter member to the modular shutter assembly and drive the third shutter into an open position only when the first shutter member and the second shutter member are simultaneously engaged by a set of plug blades.

50 Claims, 23 Drawing Sheets

U.S. PATENT DOCUMENTS 5,006,075 A 4/1991 Bowden, Jr.
5,017,153 A 5/1991 Bowman
5,020,997 A 6/1991 Calderara et al.
5,053,591 A 10/1991 Theurer
5,161,240 A 11/1992 Johnson
5,256,076 A 10/1993 Hamlin
5,267,870 A 12/1993 Maresh
5,281,156 A 1/1994 Yi
5,510,760 A 4/1996 Marcou et al.
5,711,066 A 1/1998 Castaldo
5,712,450 A 1/1998 Chan et al.
5,755,588 A 5/1998 Sweatman et al.
5,839,909 A 11/1998 Calderara et al.
5,863,221 A 1/1999 Castaldo
5,915,981 A 6/1999 Mehta
5,932,939 A 8/1999 Simmons
5,981,875 A 11/1999 Kesler et al.
6,227,883 B1 * 5/2001 Lee et al. ..... 439/106
6,341,981 B1 1/2002 Gorman
6,425,694 B1 7/2002 Szaligyi et al.
6,494,728 B1 12/2002 Gorman
6,522,510 B1 2/2003 Finlay et al.
6,570,091 B1 5/2003 Kesler et al.
6,587,319 B1 7/2003 Finlay, Sr.
6,590,753 B1 7/2003 Finlay
6,592,393 B1 7/2003 Gentle
6,624,990 B1 9/2003 Lortscher
6,688,780 B2 2/2004 Duran
6,734,769 B1 5/2004 Germain et al.
6,863,561 B2 3/2005 Gorman
6,873,231 B2 3/2005 Germain et al.
6,884,111 B2 4/2005 Gorman
6,949,994 B2 9/2005 Germain et al.
6,963,260 B2 11/2005 Germain et al.
6,969,801 B2 11/2005 Radosavljevic et al.
6,986,674 B1 1/2006 Gorman
6,998,945 B2 2/2006 Huang et al.
7,026,895 B2 4/2006 Germain et al.
7,034,224 B2 4/2006 Kim et al.
7,038,561 B2 5/2006 Esty
7,052,314 B1 5/2006 Rose
7,179,992 B1 2/2007 Packard et al.
7,307,821 B2 * 12/2007 Wang ..... 361/42
7,355,117 B2 4/2008 Castaldo et al.
7,364,444 B2 4/2008 Kellock
7,438,567 B2 10/2008 Nalwad
7,452,221 B1 11/2008 Oddsen
7,455,538 B2 11/2008 Germain
7,510,412 B1 3/2009 Valentin
7,554,034 B2 6/2009 Smith
7,588,447 B1 9/2009 Ni
7,638,710 B1 * 12/2009 Vance ..... 174/53
7,724,557 B2 * 5/2010 Ganta Papa Rao Bla et al. ..... 363/146
7,795,534 B2 * 9/2010 Lin et al. ..... 174/66
7,804,026 B2 * 9/2010 Libby et al. ..... 174/58
2004/0179787 A1 9/2004 Glazowski et al.
2004/0212466 A1 10/2004 Germain et al.
2005/0013066 A1 1/2005 Germain et al.
2005/0024171 A1 2/2005 Germain et al.
2005/0162789 A1 7/2005 Germain et al.
2006/0022777 A1 2/2006 Germain et al.
2006/0055490 A1 3/2006 Germain et al.
2007/0256850 A1 11/2007 Hansen
2008/0156512 A1 7/2008 Castaldo
2008/0224835 A1 9/2008 Noest
2009/0227130 A1 9/2009 Carbone
2009/0227131 A1 9/2009 Carbone

FOREIGN PATENT DOCUMENTS

WO 2004070906 A2 8/2004

* cited by examiner

PROTECTIVE DEVICE WITH TAMPER RESISTANT SHUTTERS

CROSS-REFERENCE TO RELATED APPLICATIONS

This is a continuation-in-part of U.S. patent application Ser. No. 11/933,928 filed on Nov. 1, 2007, now U.S. Pat. No. 7,642,457, which is a continuation of U.S. patent application Ser. No. 11/609,793 filed on Dec. 12, 2006, now U.S. Pat. No. 7,312,394, which is a continuation-in-part of U.S. patent application Ser. No. 10/900,778 entitled "A Protective Device with Tamper Resistant Shutters" filed on Jul. 28,2004, now U.S. Pat. No. 7,179,992, which is a continuation-in-part of U.S. patent application Ser. No. 10/729,685 entitled "A Protective Device with Tamper Resistant Shutters" filed on Dec. 5, 2003, now U.S. Pat. No. 7,312,963, the contents of which are relied upon and incorporated herein by reference in their entirety, and the benefit of priority under 35 U.S.C. §120 is hereby claimed.

BACKGROUND OF THE INVENTION

1. Field of the Invention

The present invention relates generally to electrical protection devices, and particularly to electrical protection devices with safety features.

2. Technical Background

As those of ordinary skill in the art understand, an electric circuit comprises many different electrical wiring devices disposed at various locations throughout a structure. These devices include outlet receptacles, which may be combined with other wiring devices such as switches, lighting devices and protective wiring devices. Ground fault circuit interrupters (GFCIs), and are fault circuit interrupters (AFCIs) are examples of protective devices in electric circuits. Each of the aforementioned protective devices have interrupting contacts for breaking the connection between the line terminals and load terminals when the protective device detects a fault condition. The connection is broken to interrupt the load current and thereby remove the fault condition. Fault conditions include those that result in risk electrocution of personnel, or fire. The outlet receptacles are disposed in duplex receptacles, raceways, multiple outlet strips, power taps, extension cords, light fixtures, appliances, and the like. Duplex receptacles may be configured for installation in outlet boxes. Once installed, a faceplate may be attached to the cover of the outlet receptacle or to the junction box to complete the installation.

Most of these devices have line terminals for connection to the power line, and load terminals for connection to a load. The load terminals include receptacle contacts and feed-thru terminals. The receptacle contacts are configured to accommodate the blades of a plug connector, which are inserted to provide power to a load. Feed-thru terminals, on the other hand, are configured to accommodate wires which are connected to one or more additional receptacles, known as a downstream receptacles. The downstream receptacle may include a string of downstream receptacles that comprise a branch circuit of an electrical distribution system.

One safety issue that heretofore has not been adequately addressed relates to the insertion of foreign objects into receptacle openings. In many cases, young children and toddlers insert objects such as paper clips or screwdriver blades into the receptacle contact openings. Unfortunately, this scenario often results in an electric shock, burns, or electrocution.

In one approach that has been considered, the electrical receptacles in the wiring device are equipped with shuttered openings that prevent the insertion of foreign objects into the receptacle contact openings. One drawback to this approach relates to the ineffectiveness of related art designs. If objects are placed into both openings, the shutter will typically operate, exposing the child to a shock hazard. What is needed is a shutter mechanism that only opens when an actual plug is being inserted into the receptacle.

Another drawback to this approach relates to the complexity of related art shutters. Many shutter designs comprise multiple parts and spring elements that are not integrated into a unitary sub-assembly. The cost and time of assembling the shutter mechanism and the space taken up by their multiple parts limit the usage of these designs. Further, automated environments often generate vibrations and mechanical forces that tend to introduce failure modes. What is needed is a unitary protective shutter assembly suitable for use within automated manufacturing processes.

SUMMARY OF THE INVENTION

The present invention addresses the needs described above. The present invention is directed to is a shutter mechanism that is configured to open only when an actual plug is being inserted into the receptacle. The shutter of the present invention defeats the insertion of one or more foreign objects into receptacle openings. The present invention is also directed to a unitary protective shutter assembly suitable for use within automated manufacturing processes.

One aspect of the present invention is directed to a protective shutter assembly for use within an electrical wiring device including a housing assembly. The housing assembly further includes a cover assembly and a rear body member, the cover assembly including at least one set of receptacle openings configured to receive a corded plug blade set having a hot plug blade and a neutral plug blade. The protective shutter assembly includes at least one shutter mechanism configured to be disposed within an interior portion of the cover assembly in alignment with the at least one set of receptacle openings. The at least one shutter mechanism includes a first shutter member having a first blade engagement structure and at least one second shutter member having at least one second blade engagement structure. The at least one second shutter member also includes a positioning tab coupled to a stationary alignment portion of the housing assembly in a locked state and decoupled from the stationary alignment portion in an unlocked state. The at least one second shutter member is slidably disposed within the first shutter member such that the first shutter member and the at least one second shutter member are movable relative to each other to drive the positioning tab from the locked state to the unlocked state when the first blade engagement structure and the second blade engagement structure are substantially simultaneously engaged by a set of plug blades to thereby enable the at least one second shutter mechanism to move from a closed position to an open position. The first shutter member and the at least one second shutter member are not movable relative to each other when the positioning tab is in the locked state. A spring member is coupled to the first shutter member and the at least one second shutter member within the shutter mechanism. The spring member is configured to bias the shutter mechanism in the closed position. A plurality of registration elements are disposed on the at least one shutter mechanism, the plurality of registration elements being configured to position and align the at least one protective shutter assembly within the cover assembly.

In another aspect, the present invention is directed to an electrical wiring device that includes a housing assembly having a cover assembly, a rear body member, a plurality of line terminals and a plurality of load terminals. The cover assembly includes at least one set of receptacle openings including a hot plug blade opening and a neutral plug blade opening having a vertical opening portion and a horizontal opening portion. The at least one set of receptacle openings is configured to receive a corded plug blade set. An electrical circuit assembly is disposed within the housing assembly and coupled to the plurality of line terminals and the plurality of load terminals. The electrical circuit assembly includes at least one set of receptacle contacts in operative alignment with the at least one set of receptacle openings. At least one shutter mechanism is configured to be disposed within an interior portion of the cover assembly and disposed between the at least one set of receptacle openings and the at least one set of receptacle contacts. The at least one shutter mechanism includes a first shutter member having a first blade engagement structure and a second shutter member having a second blade engagement structure. The second shutter member is slidably disposed within the first shutter member. The at least one shutter mechanism also includes a third shutter member having a third blade engagement structure. The third shutter member is slidably disposed within the first shutter member and coupled to the first shutter and the second shutter. The third shutter member includes a locked state and an unlocked state. The third shutter is configured to be driven to the unlocked state and open only when the first shutter member and the second shutter member move relative to each other in response to the first blade engagement structure and the second blade engagement structure being substantially simultaneously engaged by a set of plug blades.

In yet another aspect, the present invention is directed to a modular shutter assembly for use within various types of electrical wiring devices having differing amperage ratings. Each of the electrical wiring devices includes a housing assembly. The housing assembly further includes a cover assembly and a rear body member. The cover assembly includes at least one set of receptacle openings configured to receive a corded plug blade set having a hot plug blade and a neutral plug blade. The modular shutter assembly includes a first shutter member having a first blade engagement structure. The first shutter member is configured to be disposed within an interior portion of the cover assembly and disposed between the at least one set of receptacle openings and the at least one set of receptacle contacts. A second shutter member includes a second blade engagement structure. The second shutter member is slidably disposed within the first shutter member. An interface is formed in either the first shutter member or the second shutter member or both. The interface is configured to connect a third shutter member to the modular shutter assembly. The interface is configured to drive the third shutter into an open position only when the first shutter member and the second shutter member move relative to each other in response to the first blade engagement structure and the second blade engagement structure being substantially simultaneously engaged by a set of plug blades. The interface does not interfere with the operation of the first shutter member and the second shutter member when the modular shutter assembly is used without the third shutter member.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description are merely exemplary of the invention, and are intended to provide an overview or framework for understanding the nature and character of the invention as it is claimed. The accompanying drawings are included to provide a further understanding of the invention, and are incorporated in and constitute a part of this specification. The drawings illustrate various embodiments of the invention, and together with the description serve to explain the principles and operation of the invention.

DETAILED DESCRIPTION

Figure 1:
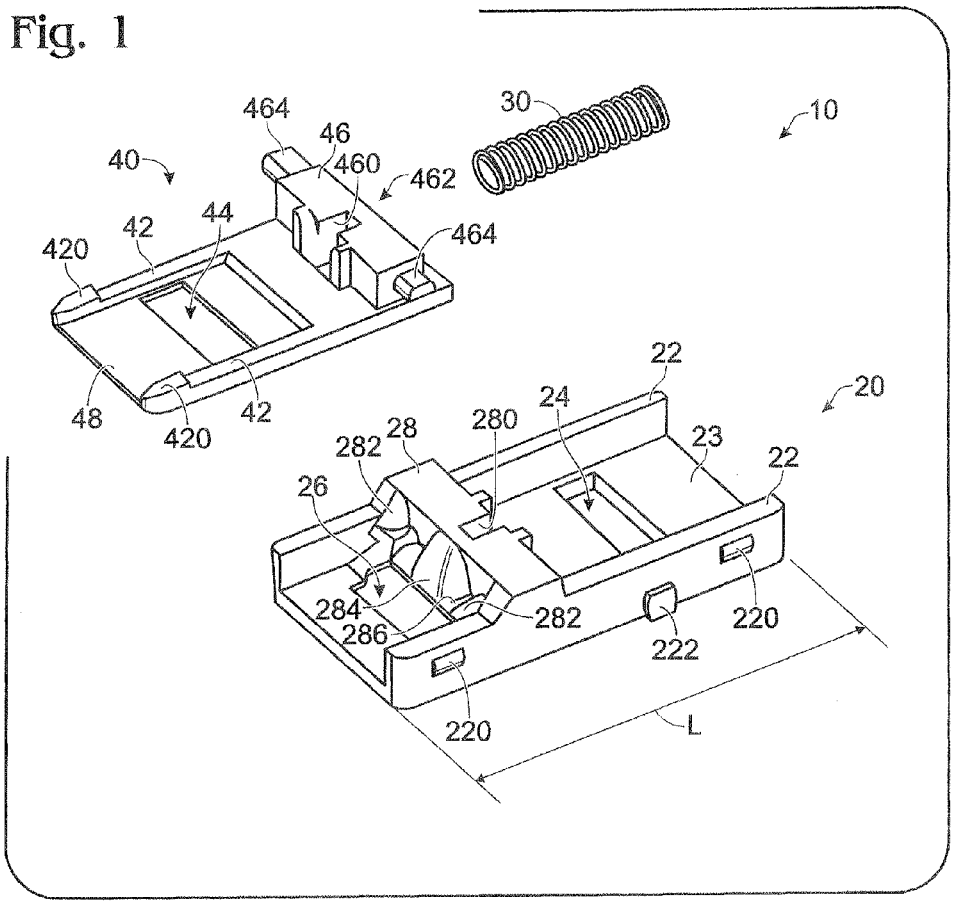
FIG. 1 is an exploded view of a protective shutter assembly in accordance with one embodiment of the present invention.

Reference will now be made in detail to the present exemplary embodiments of the invention, examples of which are illustrated in the accompanying drawings. Wherever possible, the same reference numbers will be used throughout the drawings to refer to the same or like parts. An exemplary embodiment of the protective shutter assembly of the present invention is shown in FIG. 1, and is designated generally throughout by reference numeral 10.

As embodied herein and depicted in FIG. 1, an exploded view of a protective shutter assembly 10 in accordance with one embodiment of the present invention is disclosed. The protective shutter assembly 10 is a frameless mechanism that includes a lower shutter member 20 and an upper shutter member 40. A spring member 30 is disposed between lower shutter 20 and upper shutter 40.

The lower shutter 20 includes side rails 22 and a base member 23 disposed therebetween. Base 23 has a first hot contact aperture 26 and a neutral contact aperture 24 formed therein. A transverse hot blade contact structure 28 is disposed between rails 22 and spans a portion of the first hot contact aperture 26.

Transverse contact structure 28 includes a spring retainer pocket 280, upper rail guides 282 and blade contact ramp 284. As the name suggests, upper rail guides 282 allows the rails 42 of the upper shutter to slide therebetween, allowing shutter 10 to move between the open position and the closed position. Rail guides 282 also have a rail stop function. Upper shutter rail stop members 420 abut rail guides 282 to prevent upper shutter 40 from disengaging lower shutter 20 due to the force exerted by spring 30 in the closed position.

Transverse contact structure 28 includes a blade detection geometry implemented by hot blade contact ramp 284 and ramp base 286. The hot blade contact ramp 284 is disposed in a central portion of structure 28. Ramp 284 has a predetermined width and includes contoured surfaces that recede into the face of structure 28. Those of ordinary skill in the art will recognize that the contoured surfaces will cause foreign objects having a width that is less than the predetermined width of ramp 284, such as paper clips and the like, to slide off the ramp and strike the base 286. As a result, a perpendicular force relative to the longitudinal axis of base 23 will be applied by the person wielding the object and the object will be blocked. The predetermined width of ramp 284, of course, is selected in accordance with the geometry of a proper plug blade. Those of ordinary skill in the art will understand that the contoured surface of ramp 284 may be of any suitable shape, such as an arcuate shape, a pointed shape, etc.

The upper shutter member 40 includes guide rails 42 having a base member 48 disposed therebetween. As noted above, the guide rails include a stop member 420 that is configured to abut lower shutter rail guides 282 to prevent the shutters (20, 40) from disengaging due to the force exerted by the spring 30. An upper shutter hot contact aperture 44 is disposed in base member 48.

Upper shutter member 40 also includes a transverse neutral blade contact structure 46 disposed at one end thereof. Transverse neutral blade contact structure 46 includes a spring retainer pocket 460, guide rails 42 and, like the lower shutter transverse contact structure 28, a blade detection geometry implemented by neutral blade contact ramp 462 and ramp base 465. The neutral blade contact ramp 462 is disposed at an end portion of shutter 40. In the closed position, neutral blade contact ramp 462 covers the lower shutter neutral aperture 24. Ramp 462 has a predetermined width and includes contoured surfaces that recede into the face of structure 46. Again, those of ordinary skill in the art will recognize that the contoured surfaces will cause foreign objects having a width that is less than the predetermined width of ramp 462, such as paper clips and the like, to slide off the ramp and strike the base 465. As a result, a perpendicular force relative to the longitudinal axis of base 465 will be applied by the person wielding the object and the object will be blocked. The predetermined width of ramp 462 is selected in accordance with the geometry of a proper plug blade. Those of ordinary skill in the art will understand that the contoured surface of ramp 462 may be of any suitable shape, such as an arcuate shape, a pointed shape, etc.

The protective shutter assembly 10 includes registration members disposed on the frameless shutter sub-assembly. The registration members are configured to position and align the protective shutter assembly 10 within the cover assembly of an electrical wiring device. The lower shutter includes a lower shutter longitudinal registration members 222 and the upper shutter includes an upper shutter longitudinal registration members 464. As their names suggest, the lower shutter longitudinal registration members 222 and the upper shutter longitudinal registration members 464 are configured to correctly align and position the protective shutter assembly 10 within the cover assembly at a position along a longitudinal axis of the protective shutter assembly. Protective shutter assembly 10 also includes snap-in registration members 220. The snap-in elements, of course, allows the shutter assembly 10 to be snapped, as a unit, into the cover assembly, provided that the lower shutter longitudinal registration member 222 and the upper shutter longitudinal registration member 464 are correctly registered with a corresponding registration structure within the cover assembly.

Note that the protective shutter assembly 10 is characterized by a length (L) that is approximately equal to an inch. In a 15 A embodiment, the length (L) is approximately equal to 0.860". In a 20 A device, the length (L) is approximately equal to 1.060".

Figure 2:
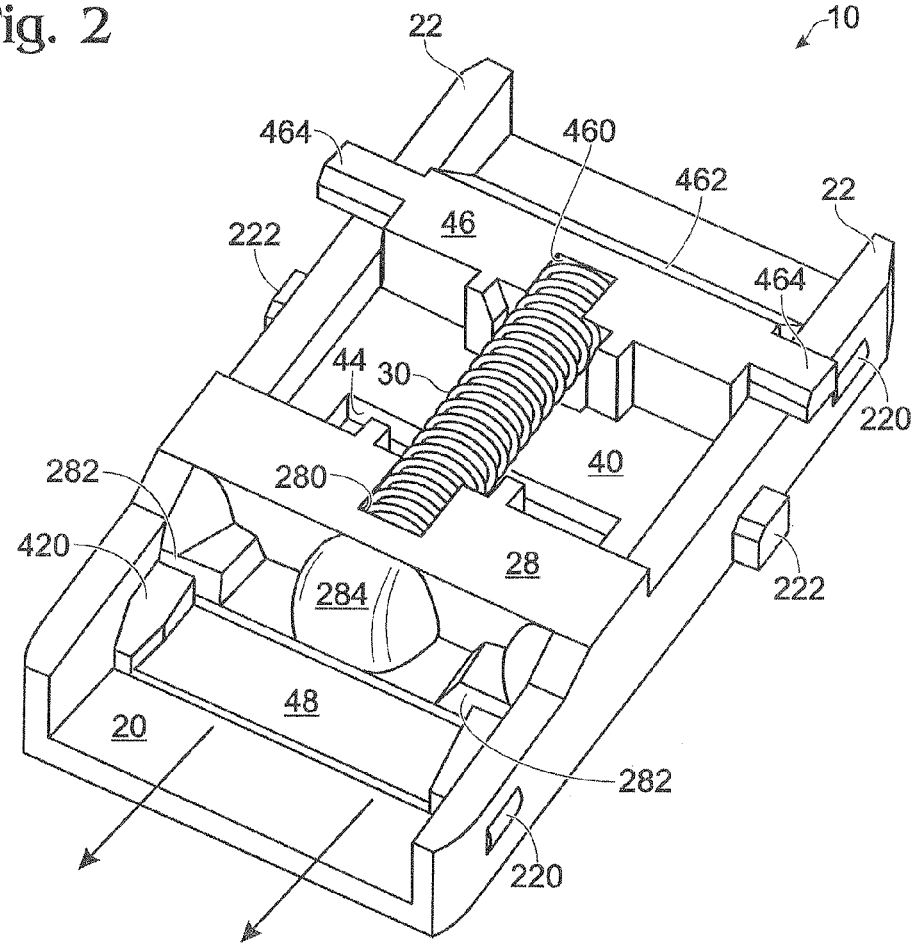
FIG. 2 is a perspective of the protective shutter assembly shown in FIG. 1.

Referring to FIG. 2, a perspective of the protective shutter assembly 10 shown in FIG. 1 is shown. When assembled, the upper shutter 40 is inserted into lower shutter 20 until stop members 420 extend beyond rail guides 282 and snap into place. This position represents the closed position, wherein upper transverse structure covers neutral aperture 24 and upper base 48 covers hot aperture 26. The lower shutter member 20 and the upper shutter member 40 are movable relative to each other from the closed position to the open position in response to being simultaneously engaged by the hot plug blade and the neutral plug blade of an electrical plug. To facilitate this movement, shutter members (20,40) are made from a family of plastics having natural lubricity. These include nylon 6-6, Delrin, and Teflon. Shutter members (20, 40) may be made from a substrate on which these materials are coated, the substrate having a differing flammability or flexural characteristic.

If a foreign object having a width substantially the same as a hot plug blade is inserted into the hot receptacle opening, the shutter assembly remains closed. The foreign object causes ramp 284, and therefore, lower shutter 20, to move. However, this foreign object insertion does not cause upper shutter 40 to move relative to shutter 20. As a result, the foreign object inserted into the hot receptacle opening strikes lower base member 48 of the upper shutter. On the other hand, if a foreign object having a width substantially the same as a neutral plug blade is inserted into the neutral receptacle opening, transverse structure 46 will move upper shutter 40 but not move lower shutter 20. Accordingly, the lower base member 23 does not move and the neutral aperture 24 (See FIG. 1) is not exposed. Thus, the foreign object inserted into the neutral receptacle opening strikes lower base member 23.

Only when the hot plug blade and the neutral plug blade of an electrical plug simultaneously engage ramp 284 and ramp 462, respectively, will the lower shutter member 20 and the upper shutter member 40 move relative to each other from the closed position to the open position. In the open position, the lower hot aperture 26 is aligned with the upper hot contact aperture 44 and, the inward edge of the lower neutral contact aperture 24 is substantially aligned with the outer edge of ramp 462. In this position, the lower shutter 20 and the upper shutter 40 allow the plug contact blades to pass through the protective shutter 10 and engage the contacts disposed in the interior of the electrical wiring device.

In another embodiment, the predetermined electrical plug geometry that opens the shutters may include only some of the characteristics that have been described. The geometry may include just one or more of the following: two plug blades separated by a predetermined distance, plug blades contacting the two blade structures simultaneously, a neutral plug blade having a predetermined width, or a hot plug blade having a predetermined width. Plug blade width will not matter if ramps 284 and/or 462 approach the widths of their respective contact structures.

The movement of the upper shutter 40 and the lower shutter 20 is effected by spring member 30. The spring member 30 is configured to bias the frameless shutter sub-assembly, i.e., lower shutter 20 and upper shutter 40, in the closed position. Spring member 30 is compressed further in the open position and, therefore, opposes movement of the frameless shutter sub-assembly from the closed position to the open position. Accordingly when the electrical plug is removed, the spring moves the frameless shutter sub-assembly from the open position to the closed position. Stated differently, only a single spring is necessary to effect the closed position of the shutter assembly.

As alluded to above, the protective shutter assembly 10 includes a spring retainer mechanism. The spring retainer mechanism includes lower shutter retainer pocket 280 and upper shutter retainer pocket 460. The spring retainer mechanism is configured to retain the spring member 30 within the frameless shutter sub-assembly and substantially prevent the spring member from being separated from the frameless shutter sub-assembly. As those of ordinary skill in the art will appreciate, the protective shutter assembly 10 may be dropped and/or exposed to vibrational and/or mechanical forces during automated assembly. As shown in FIG. 1, retainer pockets (280, 460) are equipped with retainer lips that prevent the spring member from being jarred loose.

Figure 3:
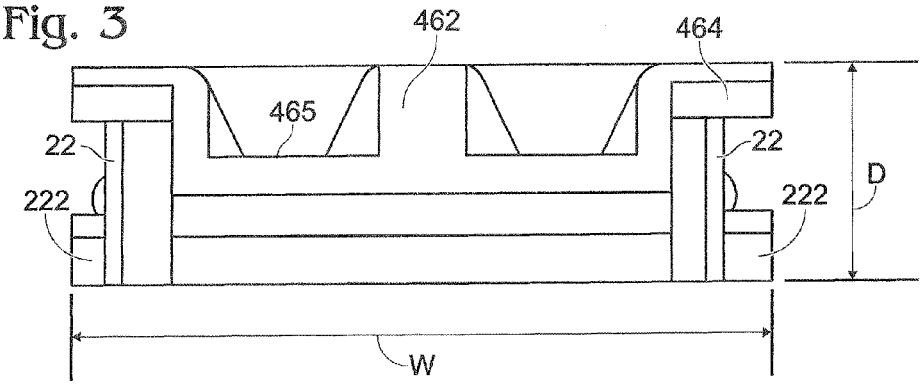
FIG. 3 is an elevation view of the protective shutter assembly shown in FIG. 1.
Figure 4:
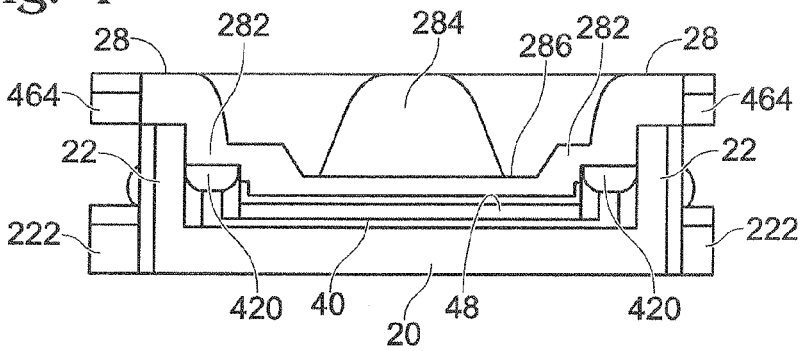
FIG. 4 is another elevation view of the protective shutter assembly shown in FIG. 1.

Referring to FIG. 3 and FIG. 4, elevation views of each end of the protective shutter assembly 10 are provided. FIG. 3 shows the upper shutter ramp 462. Upper shutter registration members 464 protrude over lower shutter rails 22 approximately the same distance lower shutter registration members 222 extend outwardly from rails 22. The blade detection features of ramp 462 were discussed in detail above.

As shown in FIG. 3, the protective shutter assembly 10 is characterized by a width (W) and a depth dimension (D). In one embodiment of the present invention the width (W) is less than or equal to 0.5 inches. In one implementation, the width (W) is approximately 0.460 inches. The depth, or thickness, of the device is typically less than or equal 0.2 inches. In one implementation the depth (D) is approximately equal to 0.170 inches.

The elevation view in FIG. 4 shows the lower shutter ramp 284 in detail. The blade detection features of ramp 284 were discussed in detail above. FIG. 4 illustrates the base portion 48 of shutter 40 disposed between ramp base 286 and the bottom of lower shutter 20. Stop member 420 is also shown in the locked position relative to rail guides 282.

Figure 5:
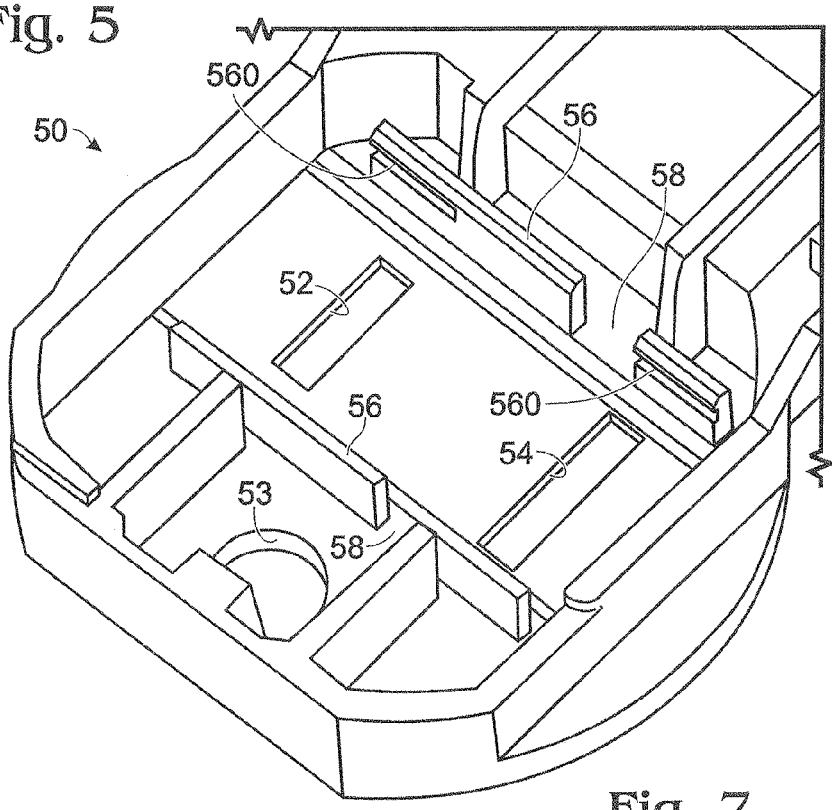
FIG. 5 is a detail view of a cover assembly in accordance with an embodiment of the present invention.

As embodied herein and depicted in FIG. 5, a detail view of a cover assembly 50 in accordance with an embodiment of the present invention is disclosed. The cover assembly 50 is shown to include hot receptacle opening 52 and neutral receptacle opening 54. Those of ordinary skill in the art will understand that the shape and size of the receptacle openings is determined by the geometry of the type of service, i.e., 15 A, 20 A, etc., and the corresponding plug blades. Of course, the cover assembly 50 mates with a wiring device housing that includes a plurality of receptacle contacts. The hot 52, neutral 54, and ground 53 openings are in communication with their corresponding receptacle contacts in the open position. The electrical plug may include pins instead of blades in which case the corresponding receptacle openings are circular instead of rectangular. Ramps (286,462) are then configured to allow predetermined pin shapes to open the shutter assembly.

Cover assembly 50 includes a pair of cover registration structures 560, each including a registration alignment key 58 disposed therein. Each alignment key 58 accommodates a lower shutter longitudinal registration member 222 and an upper shutter longitudinal registration member 464. The position of alignment key 58 ensures that the protective shutter assembly 10 is positioned within cover assembly 50 such that the hot aperture 26, neutral aperture 24, and the ramp structures (284, 462) and base portions (23,48) are correctly aligned with the receptacle openings (52, 54).

Each registration structure 560 includes a registration groove 560 that is configured to mate with snap-in registration member 220 (See FIG. 1). As discussed above in some detail, registration member 220 is configured to snap into registration groove 560 to couple the frameless protective shutter assembly 10 to the cover assembly 50.

Figure 6:
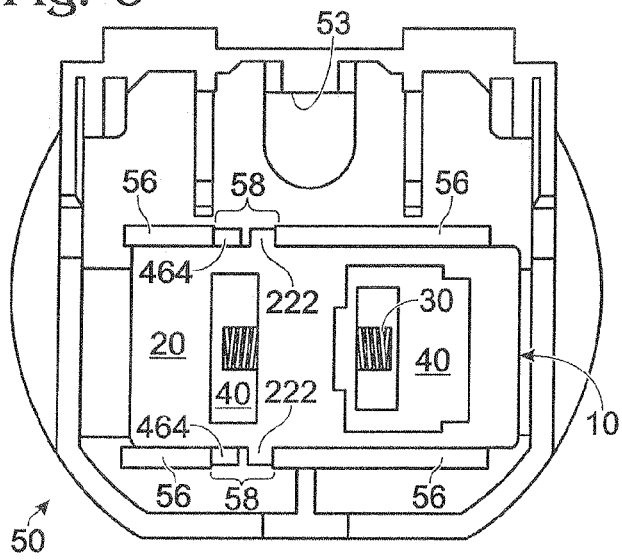
FIG. 6 is a plan view of an internal portion of the cover assembly shown in FIG. 5 with the protective shutter assembly of FIG. 1 disposed therein.

FIG. 6 is a plan view of the cover assembly 50 with the protective shutter assembly 10 disposed therein. While the Figure is self-explanatory, there are a few features worthy of further explanation. Note that lower shutter longitudinal registration member 222 and the upper shutter longitudinal registration member 464 are slightly offset one from the other within alignment key 58. The shutter assembly is shown in the closed position. Due to spring 30 being in a compressed state, the registration members 222 and 464 occupy alignment key 58 so that there is little or no longitudinal play in the shutter assembly with respect to the cover. As noted above, when the hot plug blade and the neutral plug blade of an electrical plug simultaneously engage ramp 284 and ramp 462, respectively, the lower shutter member 20 and the upper shutter member 40 move relative to each other from the closed position to the open position. FIG. 6 illustrates that lower shutter 20 also moves within the cover assembly 50. When the shutter assembly 10 is opened, the position of the lower shutter longitudinal registration member 222 and the upper shutter longitudinal registration member 464 within alignment key 58 are exchanged. However, alignment key 58 limits the movement of the lower shutter 20 and the upper shutter 40.

Figure 7:
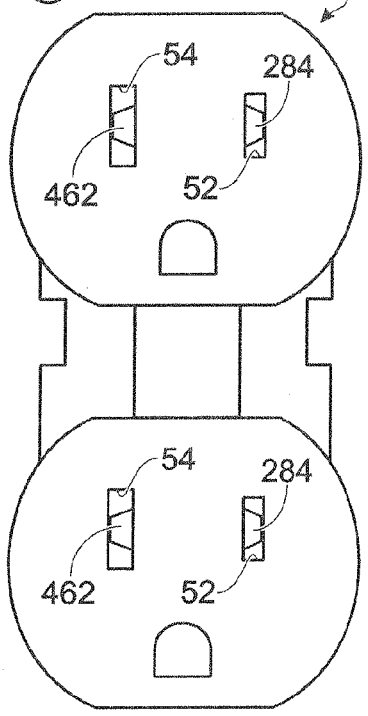
FIG. 7 is a plan view of an external portion of the cover assembly shown in FIG. 5 with the protective shutter assembly of FIG. 1 disposed therein.

Referring to FIG. 7, a plan view of an external portion of the cover assembly 50 is shown with the protective shutter assembly 10 disposed therein. As noted above, the registration features of the present invention eliminate any possibility that shutter assembly 10 will be improperly aligned within the cover assembly 50. Shutter ramp 284 is correctly aligned with hot receptacle opening 52 and shutter ramp 462 is correctly aligned with neutral receptacle opening 54.

Figure 8:
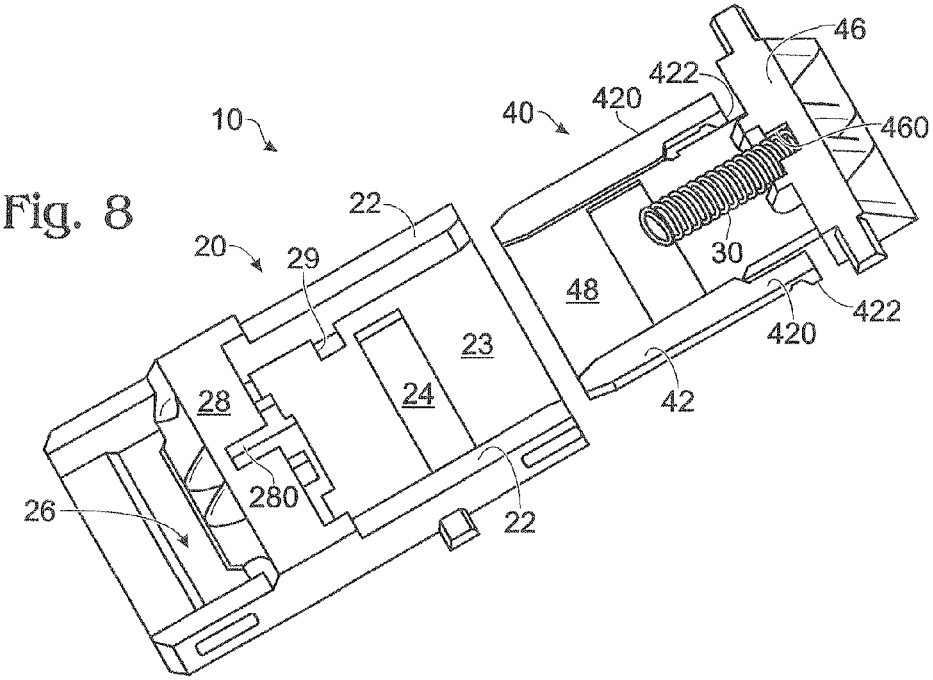
FIG. 8 is an exploded view of a protective shutter assembly in accordance with another embodiment of the present invention.

As embodied herein and depicted in FIG. 8, an exploded view of a protective shutter assembly 10 in accordance with another embodiment of the present invention is disclosed. The embodiment shown in FIG. 8 is a shutter assembly that may be employed in a 15 A wiring device and is, in fact, very similar to the device described above. The differences between the shutter assembly depicted in FIGS. 1-7 and the embodiment depicted in FIG. 8 relates to the stop mechanism. In the instant embodiment, lower shutter member 20 includes stop apertures 29 disposed in base 23 inside guide rails 22. Upper shutter member 40 includes stopping arms 420 which extend from base member 48 toward transverse member 46. Stopping arms 420 are equipped with downwardly extending stop members 422, which are configured snap into apertures 29 when the two shutters are assembled together during manufacturing assembly. Spring 30 then urges stop members 422 to travel in apertures 29 to the closed position.

When the lower shutter member 20 and the upper shutter member 40 move toward each other when going from the closed position to the open position, stop members 422 slide in the reverse direction in apertures 29, moving toward lower transverse member 28.

Figure 9:
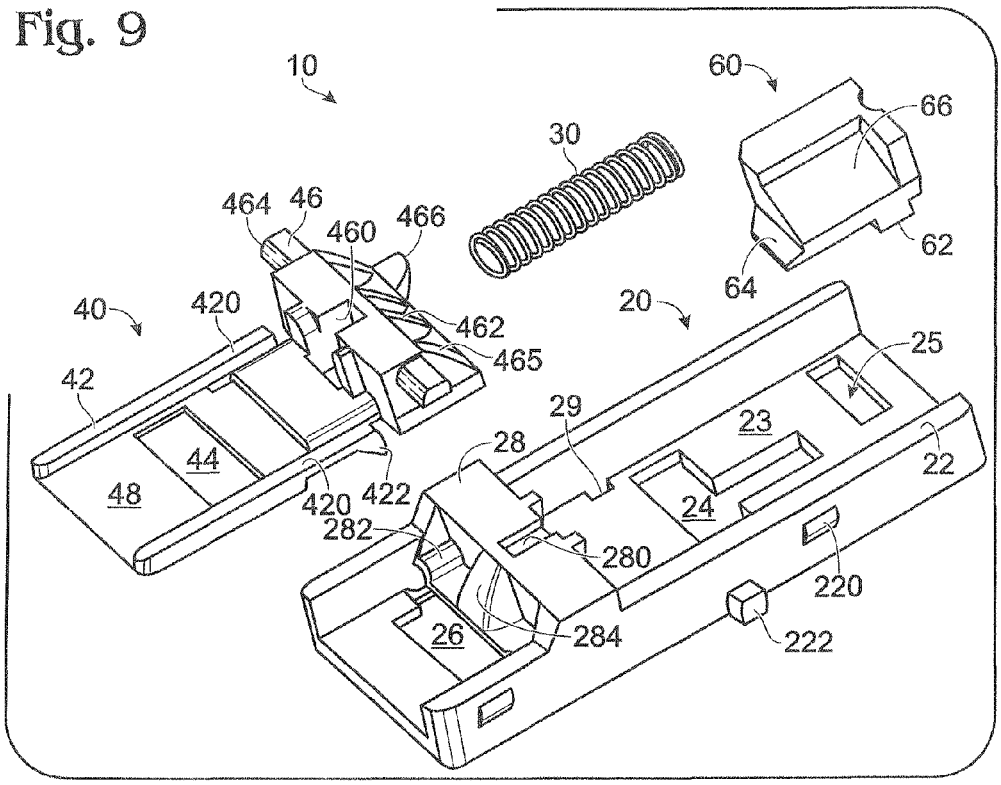
FIG. 9 is an exploded view of a protective shutter assembly in accordance with yet another embodiment of the present invention.

As embodied herein and depicted in FIG. 9, an exploded view of a protective shutter assembly in accordance with yet another embodiment of the present invention is disclosed. The embodiment shown in FIG. 9 is a shutter assembly that may be employed in a 20 A wiring device. The hot and neutral receptacle openings are perpendicular to each other so as to accommodate the blades of 20 A plugs. The neutral receptacle opening for the 20 A outlet receptacle may be in the shape of a "t-slot" so that either 15 A plugs (parallel blades) or 20 A plugs (perpendicular blades) may be inserted. Most of the mechanisms employed in the 15 A shutter assembly depicted in FIGS. 1-7 are employed herein. The differences between the 20 A shutter assembly and the 15 A shutter assembly depicted in FIGS. 1-7 relate to the 20 A neutral blade shutter.

Like the 15 A shutter assembly, the 20 A protective shutter assembly 10 is a frameless mechanism that includes a lower shutter member 20 and an upper shutter member 40. A spring member 30 is disposed between lower shutter 20 and upper shutter 40. The lower shutter 20 includes side rails 22 and a base member 23 disposed therebetween. Base 23 has a first hot contact aperture 26 and a neutral contact aperture 24 formed therein (note that aperture 24 is shaped as a t-aperture to be able to accommodate either a 15 A or 20 A plug when the shutter assembly is in the open position). A transverse hot blade contact structure 28 is disposed between rails 22 and spans a portion of the first hot contact aperture 26. Transverse contact structure 28 includes a spring retainer pocket 280, upper rail guides 282 and blade contact ramp 284. The blade contact ramp 284 is equipped with a blade detection geometry implemented by hot blade contact ramp 284 and ramp base 286.

The upper shutter member 40 includes guide rails 42 having a base member 48 disposed therebetween. As noted above, the guide rails 42 include a stop member 420 that is configured to abut lower shutter rail guides 282 to prevent the shutters (20, 40) from disengaging due to the force exerted by the spring 30. An upper shutter hot contact aperture 44 is disposed in base member 48. Upper shutter member 40 also includes a transverse neutral blade contact structure 46 disposed at one end thereof. Transverse neutral blade contact structure 46 includes a spring retainer pocket 460, guide rails 42 and, like the lower shutter transverse contact structure 28, a blade detection geometry implemented by neutral blade contact ramp 462 and ramp base 465.

Unlike the 15 A shutter assembly, the 20 A embodiment includes a slot 25 disposed in the base portion 23 of the lower shutter 20. A 20 A shutter member 60 is disposed in the slot 25. The 20 A shutter member 60 is operable in conjunction with the upper shutter member 40 and is employed to block a portion of the T-slot receptacle opening in the closed position. The 20 A shutter member 60 includes an insert member 62, tooth portion 64, and ramp portion 66. The insert portion 62 is configured to snap into slot 25 but is also slideable along the axis of slot 25. The upper transverse member 46 of shutter 40 includes a cam member 466 that is configured to engage the tooth portion 64. The ramp portion 66 aligns with t-slot opening 54, being configured to engage a portion of a 20 A neutral plug blade. The operation of the 20 A shutter mechanism 60 will be described below.

Figure 10:
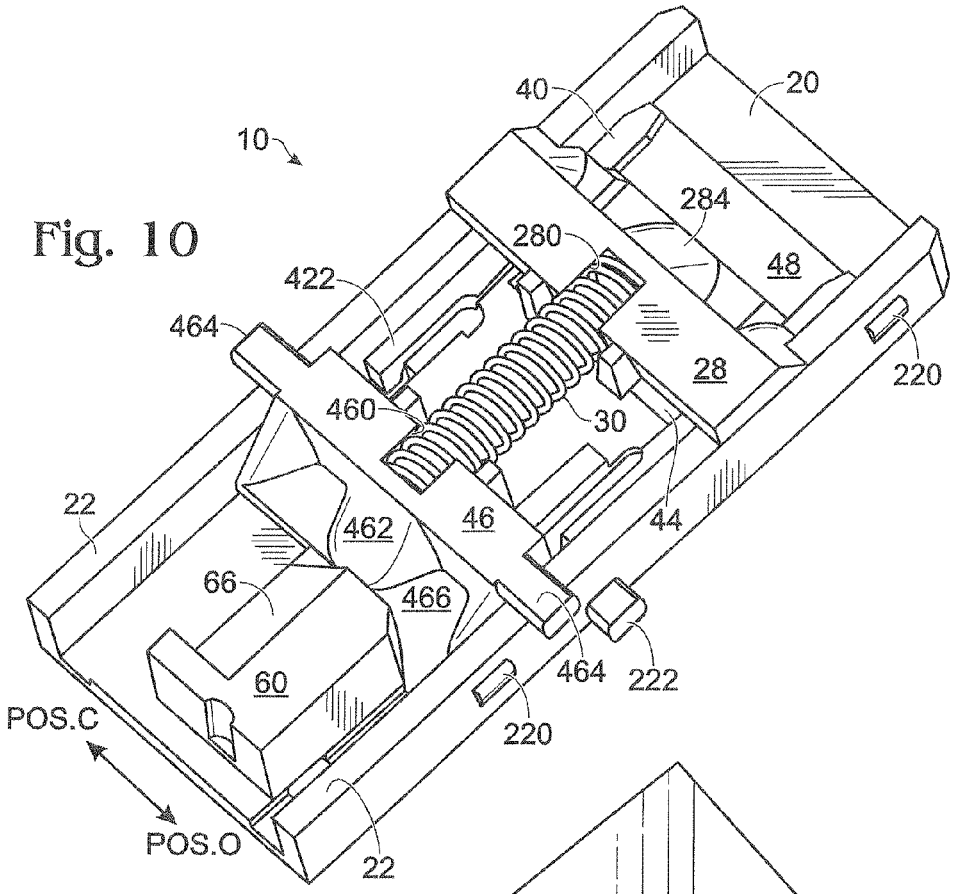
FIG. 10 is a perspective of the protective shutter assembly shown in FIG. 9.

FIG. 10 is a perspective of the protective shutter assembly shown in FIG. 9. When shutter 40 is in the closed position, the resulting interference between cam 466 and tooth portion 64 locks shutter member 60 in the closed position. As previously described in detail, foreign objects inserted into either the hot receptacle opening 52 or the 15 A portion of the t-slot opening 54 cannot move upper shutter 40 (or lower shutter 20) to their open positions. Accordingly, a foreign object inserted in the 20 A portion of t-slot opening 54 cannot open shutter member 60.

In operation, an edge portion of a 20 A neutral plug blade initially engages ramp 462. Since the edge portion is aligned to the ramp 462 by t-slot opening 54, the edge portion cannot slide off of the ramp as would a foreign object. Thus the edge portion is able to move shutter 40 toward the open position as it is being inserted. At the same time, cam 466 moves away from tooth portion 64. Since shutter 60 is no longer locked, the side portion of the 20 A neutral plug blade engages ramp 66 and urges shutter 60 from "Pos. C" towards "Pos. O" (FIG. 10). This unblocks a portion of the T-slot opening. At substantially the same instant in time, the hot plug blade engages ramp 284. Again, the lower shutter member 20 and the upper shutter member 40 are movable relative to each other from the closed position to the open position in response to being simultaneously engaged by a hot plug blade and the neutral plug blade. The three shutters are configured to allow a 20 A plug to make electrical connection with the receptacle contacts when in the open position. When shutter 40 returns to the closed position, the cam member 466 is configured to urge the 20 A shutter member 60 in the direction from "Pos. O" to "Pos. C". Shutters 40 and 60 thereby close the t-slot opening. As has been described at length, the closed position of the 20 A shutter assembly comprised of shutters 20, 40 and 60 depend from a single spring (spring 30).

Figure 11:
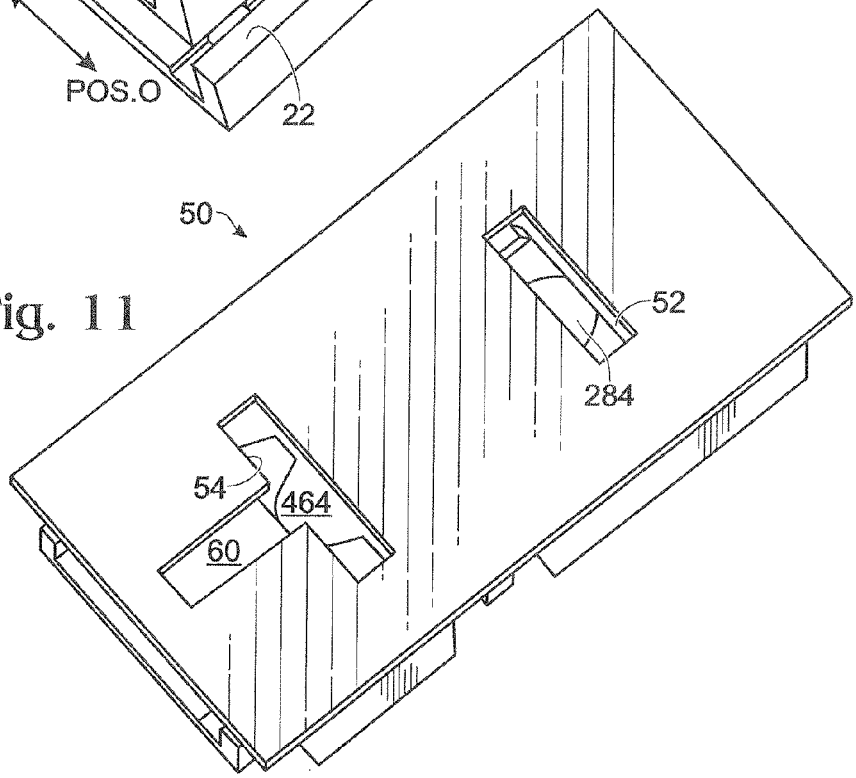
FIG. 11 is a plan view of an external portion of a cover assembly shown with the protective shutter assembly of FIG. 9 disposed therein.

Referring to FIG. 11, a plan view of an external portion of a cover assembly 50 is shown with the protective shutter assembly of FIG. 9 disposed therein. The registration system employed in the 15 A system is applicable to the 20 A embodiment. Accordingly, shutter ramp 284 is correctly aligned with hot receptacle opening 52 and the neutral shutter ramps 464, 60 are correctly aligned within T-slot 54.

Figure 12:
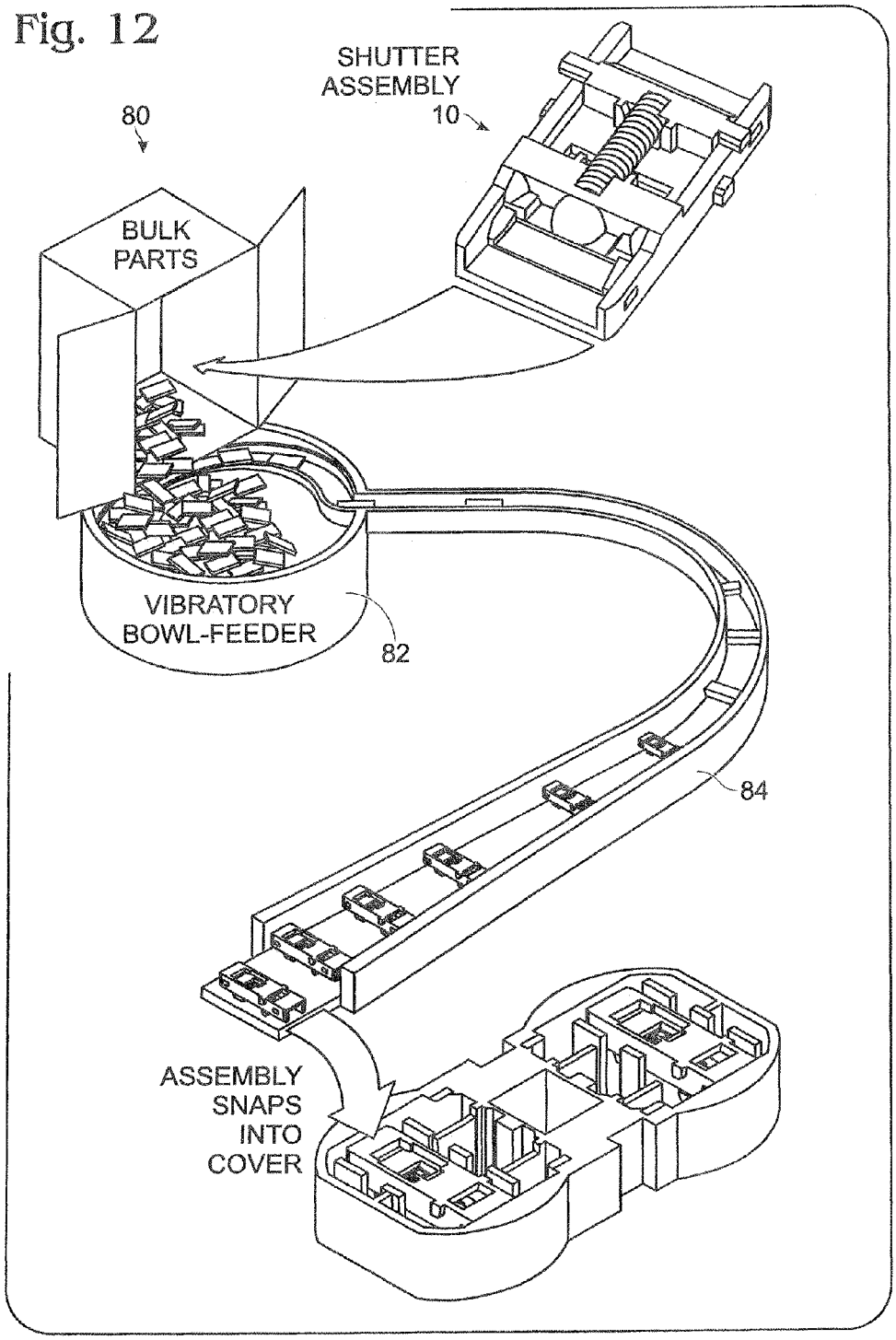
FIG. 12 is diagrammatic depiction of an automated process for assembling the protective shutter assemblies of the present invention within a cover of an electrical wiring device.

As embodied herein and depicted in FIG. 12, a diagrammatic depiction of an automated process 80 for assembling protective shutters 10 within an electrical wiring device cover 50 is disclosed. One of the drawbacks of related art devices relates to their unsuitability for automated assembly. Many such devices includes framing members, multiple spring elements, and other parts that complicate an automated assembly process.

Turning to FIG. 12, protective shutter assemblies 10 are provided in bulk and are transferred to a vibratory bowl feeder 82. During the loading process the shutter assemblies 10 may be subjected to mechanical forces as they are dropped into bowl feeder 82. The bowl feeder 82 itself applies vibrational forces to align and direct the shutters into the feeder line 84. Note that because of the frameless two-piece design and the spring retaining features, the mechanical and/or vibrational forces applied to the shutter assembly 10 do not adversely impact shutter assembly reliability.

When each individual shutter reaches the end of the feeder line 84, a robotic assembly tool (not shown) takes the shutter assembly 10 from the feeder line 84 and positions it within the cover assembly. The robotic assembly tool is designed and programmed to couple the shutter 10 to cover assembly 50 by mating the shutter assembly registration members (220, 464, 222) to their corresponding cover registration structures (56, 58, 560) as shown in FIG. 6. The registration and alignment features of the present invention facilitate the automated disposition of the frameless protective shutter assembly 10 within the cover assembly in correct alignment with the receptacle openings.

Figure 13:
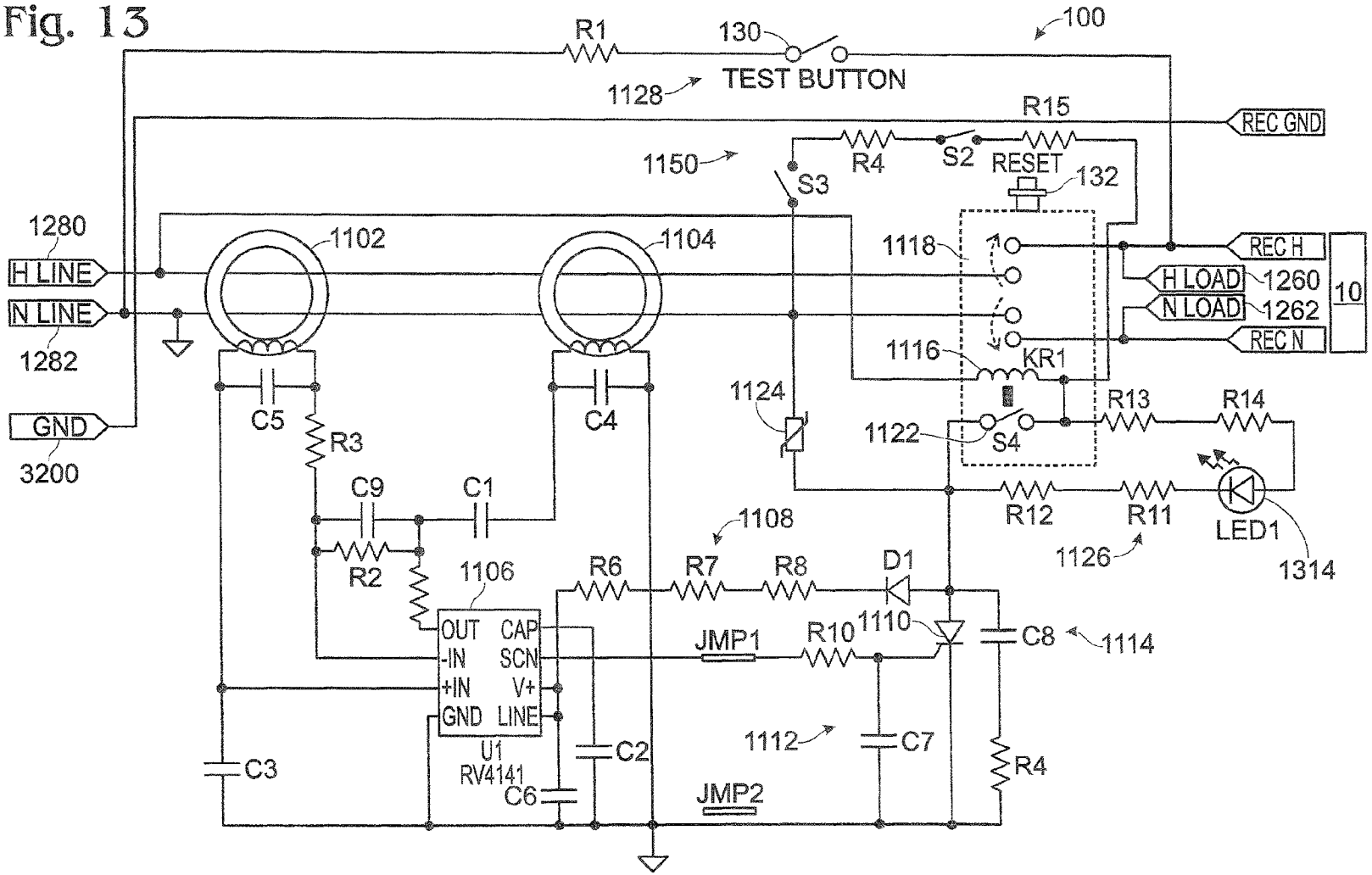
FIG. 13 is a schematic diagram of a ground fault circuit interrupter in accordance with an embodiment of the present invention.

As embodied herein and depicted in FIG. 13, a schematic diagram of a ground fault circuit interrupter 100 in accordance with an embodiment of the present invention is disclosed. Moving from left to right in the schematic, it is seen that GFCI 100 includes hot line male terminal element 1280, neutral line receptacle blade 1282, and ground receptacle blade 3200. On the load side of device 12, there is hot load male terminal element 1260, neutral load male terminal element 1262 and a pair of user accessible receptacles, each including a hot receptacle terminal and a neutral receptacle terminal. In accordance with the present invention, the hot receptacle terminal and the neutral receptacle terminal are coupled to and protected by shutter assembly 10.

The ground fault circuitry includes a differential transformer 1102 which is configured to sense load-side ground faults. Transformer 1104 is configured as a grounded neutral transmitter and is employed to sense grounded-neutral fault conditions. Both transformers are disposed in toroid assembly L1. Both (LINE) conductors pass thru the sensors. Differential transformer 1104 senses currents from HOT to GROUND but not HOT to NEUTRAL. Both differential transformer 1102 and grounded-neutral transformer 1104 are coupled to detector integrated circuit 1106. Detector 1106 is powered by a power supply circuit 1108 connected to pin $V^+$ on detector 1106. The detector output, provided on output pin SCR, is connected to the control input of SCR 110. Filter 1112, comprising resistor R10 and capacitor C7, low-pass filter the detector output signal. GFCI 100 also includes a snubber circuit 1114 that includes resistor R4 and capacitor C8. Snubber circuit 1114 prevents voltage transients from triggering SCR 1110.

When SCR 1110 is turned ON, solenoid 1116 is energized, actuating circuit interrupter 1118. Solenoid 1116 remains energized for a time period that is typically less than about 25 milliseconds. Circuit interrupter 1118 trips, resulting in the line terminals being disconnected from respective load terminals. After the fault condition has been eliminated, the circuit interrupter 1118 may be reset by way of reset button 132. In one embodiment, the reset mechanism actuated by reset button 132 is purely mechanical in nature and does not include any electrical contacts for test initiation.

GFCI 100 addresses certain end of life conditions by denying power to the load when the device is unable to function. As an example of an end-of-life condition, solenoid 1116 is susceptible to burn-out if SCR 1100 becomes shorted out, or is permanently turned ON. Solenoid 1116 may burn out if it is energized for more than about 1 second. Once the solenoid 1116 burns out, the circuit interrupter 1118 is incapable of being tripped. Solenoid burn-out prevention is provided by auxiliary switch 1122.

Auxiliary switch 1122 is configured to open when the circuit interrupter 1118 is in the tripped position. If SCR 1110 is shorted out, or permanently ON, auxiliary switch 1122 ensures that solenoid 1116 is not permanently connected to a current source. The user may attempt to reset GFCI 100 by depressing the reset button 1120, but the circuit interrupter 1118 will immediately trip in response to the current flowing through the solenoid 1116. Because the trip mechanism 1118 is coupled to the auxiliary switch 1122, auxiliary switch 1122 is opened before solenoid 1116 burns out.

Another failure mode that is addressed by GFCI 100 relates to the end-of-life failure mode of movistor (MOV) 1124. MOV 1124 is disposed in series with auxiliary switch 1122 and trip solenoid 1116. This arrangement significantly reduces the probability of damage due to an over-current situation. When MOV 1124 reaches end-of-life and shorts out, trip solenoid 1116 is energized and auxiliary switch 1122 is opened. As previously described, when auxiliary switch 1122 opens, the flow of short circuit current is terminated before any damage to GFCI 100 ensues.

GFCI 100 also includes trip indication circuit 1126. Trip indicator 1126 is implemented by placing LED1 and series resistors (R11-R14) in parallel with auxiliary switch 1122. LED1 is configured to emit a visual signal when circuit interrupter 1118 and auxiliary switch 1122 are in an open state (tripped).

GFCI 100 also includes a test circuit 1128. The test circuit 1128 is coupled between the line neutral terminal 1282 and the hot receptacle terminal. The test circuit includes a test button 130 disposed in series with test resistor R1.

Finally, GFCI 100 is equipped with a miswire circuit 1150. If an installer improperly connects the load terminals (1260, 1262) to a source of AC power, the miswire circuit 1150 generates a differential current that is detected in accordance with the procedures outlined above. The device 100 continues to trip out until the installer properly wires the device. When the device is properly wired, current flows unabated through miswire circuit 1150, whether GFCI 100 is tripped or not. Fuse S2 is designed to open-circuit after a predetermined period of time. Thus, miswire circuit 1150 is disabled once the GFCI 100 is correctly wired.

Reference is made to U.S. patent application Ser. No. 11/531,588, which is incorporated herein by reference as though fully set forth in its entirety, for a more detailed explanation of the GFCI circuit.

Figure 14:
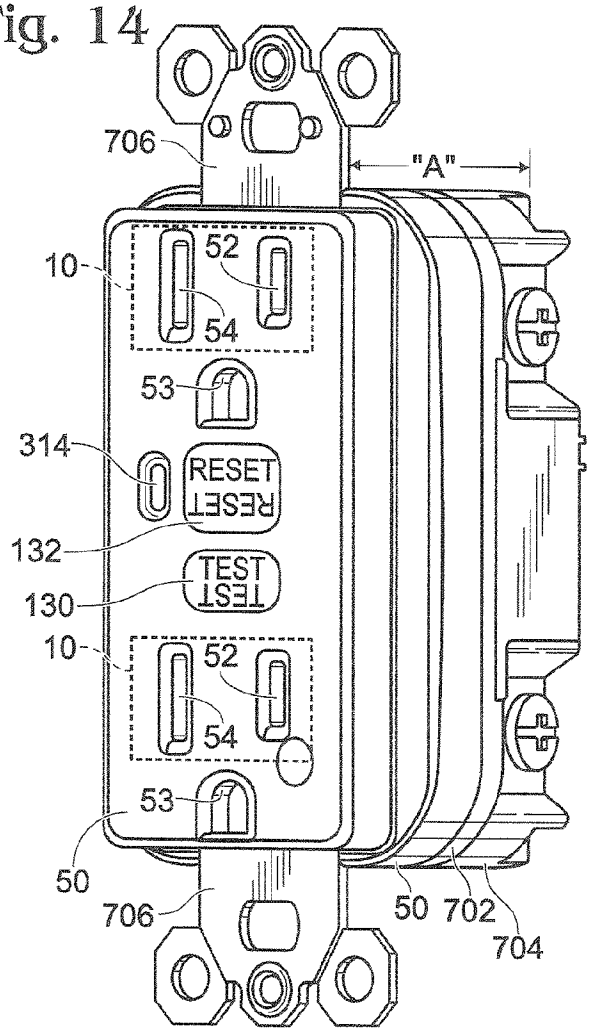
FIG. 14 is a perspective view of a GFCI receptacle in accordance with another embodiment of the present invention.

FIG. 14 is a perspective view of the GFCI 100 depicted in FIG. 13. The GFCI receptacle 100 includes a front cover assembly 50. Cover assembly 50 includes openings extending therethrough to receive the prongs of a standard form of male plug in conventional fashion. Each set of openings includes a hot receptacle opening 52, a neutral receptacle opening 54, and a ground receptacle opening 53. At least the hot receptacle opening 52 and the neutral receptacle opening 54 are protected by shutter assembly 10 (dashed lines) disposed within cover 50 in the manner previously described. GFCI 100 includes a body member 704. A component separator 702 is sandwiched between cover assembly 50 and body member 704. In an alternate embodiment, separator 702 may be entirely enclosed by cover assembly 50 and body member 704. Line terminals and load terminals are electrically coupled, of course, to interior electrical components in accordance with the schematic shown in FIG. 13. As those of ordinary skill in the art will appreciate, the cover assembly 50, separator 702, and body member 704 are formed from an electrically non-conductive material. Device 100 also includes mounting ears 706 that restrict the insertion depth of the device into the outlet box by a distance represented by dimension 'a.' Dimension 'a' is the distance between the back side of mounting ears 706 and the major rear surface of body member 704. The major rearward surface may be interrupted by protuberances associated with labels, terminals, relief pockets for internal components, and the like.

In one embodiment of the present invention, dimension 'a' is less than or equal to one (1.00) inch. The major rearward surface occupies at least 80% of the overall rear surface. In one embodiment, the mounting ears 706 are made from a non-conductive material. In an alternate embodiment, the mounting ears 706 are the exposed ends of an electrically conductive strap assembly connected to the grounding conductor of the electrical distribution system when the device 100 is installed. The conductive strap is connected to the receptacle ground terminals that accommodate the ground prong of the user attachable plug. The housing depicted in FIG. 14 may also be suitable for other GFCI embodiments as well as arc fault circuit interrupter (AFCI) embodiments.

Figure 15:
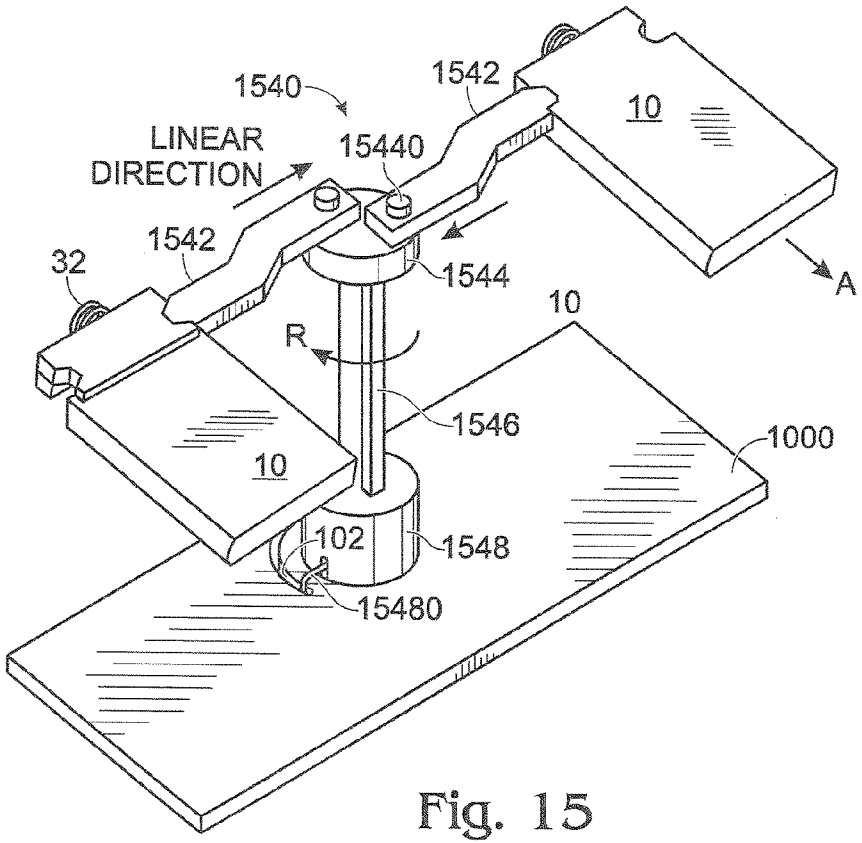
FIG. 15 is a detail view of a miswire lockout mechanism in accordance with the present invention.

FIG. 15 is a detail view of a miswire lockout mechanism that may be employed in conjunction with the GFCI 100 depicted in FIG. 13 and FIG. 14. A linkage assembly 1540 is disposed within the housing 704 (See FIG. 14). The linkage assembly 1540 mechanically couples the protective frameless shutter sub-assembly 10 to the miswire circuit 1150 (FIG. 13). Before device 100 is wired correctly, each protective shutter 10 is disposed in a locked position. The locked position, in effect, misaligns the shutter assembly 10, such that plug blades or other objects cannot make contact with the receptacle contacts. Miswire circuit 1150 is used to determine when device 100 has been properly wired. When the device has been properly wired, miswire circuit 1150 actuates linkage assembly 1540 causing the protective frameless shutter sub-assembly 10 to move from the locked position to the unlocked position. In the unlocked position, the shutter assembly is correctly aligned such that plug blades are permitted to make contact with the receptacle contacts upon insertion of the plug blades into the receptacle openings. However, as explained in detail above, frameless shutter sub-assembly 10 prevents objects that are inserted into individual receptacle openings from making contact with the receptacle contacts.

Linkage assembly 1540 includes two pivot arms 1542, each of which are removably coupled to a protective shutter 10 in the closed position. Cam member 1544 is coupled to pivot arms 1542, by way of pivots 15440. The cam member 1544 is configured to rotate around an axis of rotation to thereby move the pivot arms 1542 in the linear direction as shown. Rotor 1546 is coupled to cam 1544 at one end, and is also coupled to circuit board 1000 at an opposite end. A torsion spring assembly 1548 is coupled to rotor 1546. Spring assembly 1548 includes torsion spring 15480 which is coupled to the miswire circuit 1150 disposed on the other side of circuit board 1000.

In the locked position, torsion spring 15480 is in tension, and stores mechanical energy. When miswire circuit 1150 senses the proper wiring condition, it releases spring 15480, allowing it to move within slot 102. The stored mechanical energy is released, causing rotor 48 to rotate cam 46 about the axis of rotation. In response, each pivot arm 42 is moved in a linear direction as shown. In one embodiment of the present invention, torsion spring 15840 is held in place by a fuse element (S2) that is configured to open-circuit after current is applied for a predetermined period of time. The operation of the miswire circuit 1150 and fuse S2 was discussed above in detail.

Reference is made to U.S. Pat. No. 6,969,801 and U.S. patent application Ser. Nos. 10/729,685 and 10/900,788, which are incorporated herein by reference as though fully set forth in its entirety, for a more detailed explanation of the tamper resistant shutter mechanisms.

Figure 16:
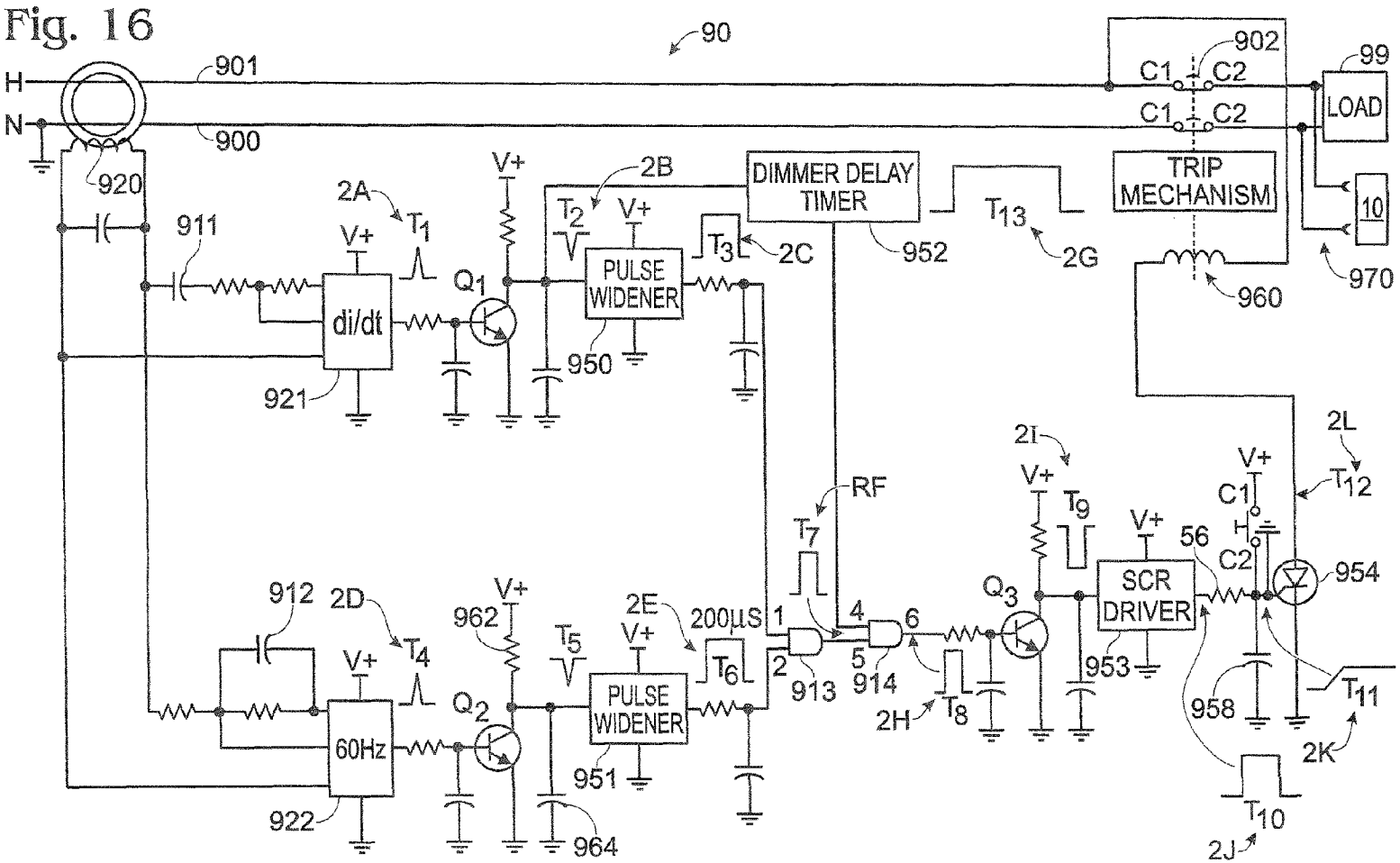
FIG. 16 is a schematic diagram of an arc fault circuit interrupter in accordance with an embodiment of the present invention.

FIG. 16 is a schematic diagram of an arc fault circuit interrupter in accordance with an embodiment of the present invention. As those of ordinary skill in the art will appreciate, the housing depicted in FIG. 14 is readily adapted to the AFCI embodiment described herein. Referring to FIG. 16, the load terminals are coupled to receptacle load terminals 970. The receptacle load terminals 970 are, in turn, protected by shutter assembly 10.

AFCI 90 is formed from components that are readily available and that can be easily integrated into an electrical receptacle, plug, or in-line device. The circuit is designed so that it can be manufactured in the same form as ground fault circuit interrupter (GFCI) receptacle devices. AFCI 90 protects an electrical circuit which includes at least a neutral conductor 900 and a line conductor 901 connected to a power source (not shown). A ground conductor (not shown) is optionally present. AFCI 90 detects electrical arcs occurring between line conductor 901 and ground, neutral conductor 900 and ground should the power source be of reverse polarity, or line conductor 901 and neutral conductor 900.

A circuit interrupter 902 is connected in series with line conductor 901 between the power source and a load 99. This embodiment incorporates a first stage arc sensor 920, shown as a current transformer, which is configured to respond to the rate of change of neutral and/or line conductor current with respect to time. Sensor 920 may be designed with a physically small core of a type and number of secondary turns which gives optimum sensitivity during arcing. Either a single conductor (LINE) or both conductors can pass thru the sensor. The arc fault detector detects arcs that are either LINE to GROUND or LINE to NEUTRAL. Sensor 920 feeds two detector/amplifiers 921, 922. Detector/amplifiers 921, 922 are preferably RV4141A (Fairchild Semiconductor) low power ground fault interrupter ICs. Detector/amplifier 921, also referred to as the di/dt stage, has a high pass filter capacitor 911 on its input side, while detector/amplifier 922, also referred to as the 60 Hz or "threshold" stage, uses a low pass filter capacitor 912 in a feedback stage. The 60 Hz threshold detector 922 controls the level at which an arcing condition is to be detected, e.g., at a 75 Ampere or greater load current.

Reference is made to U.S. patent application Ser. No. 11/531,588, which is incorporated herein by reference as though fully set forth in its entirety, for a more detailed explanation of the AFCI circuit.

Figure 17:
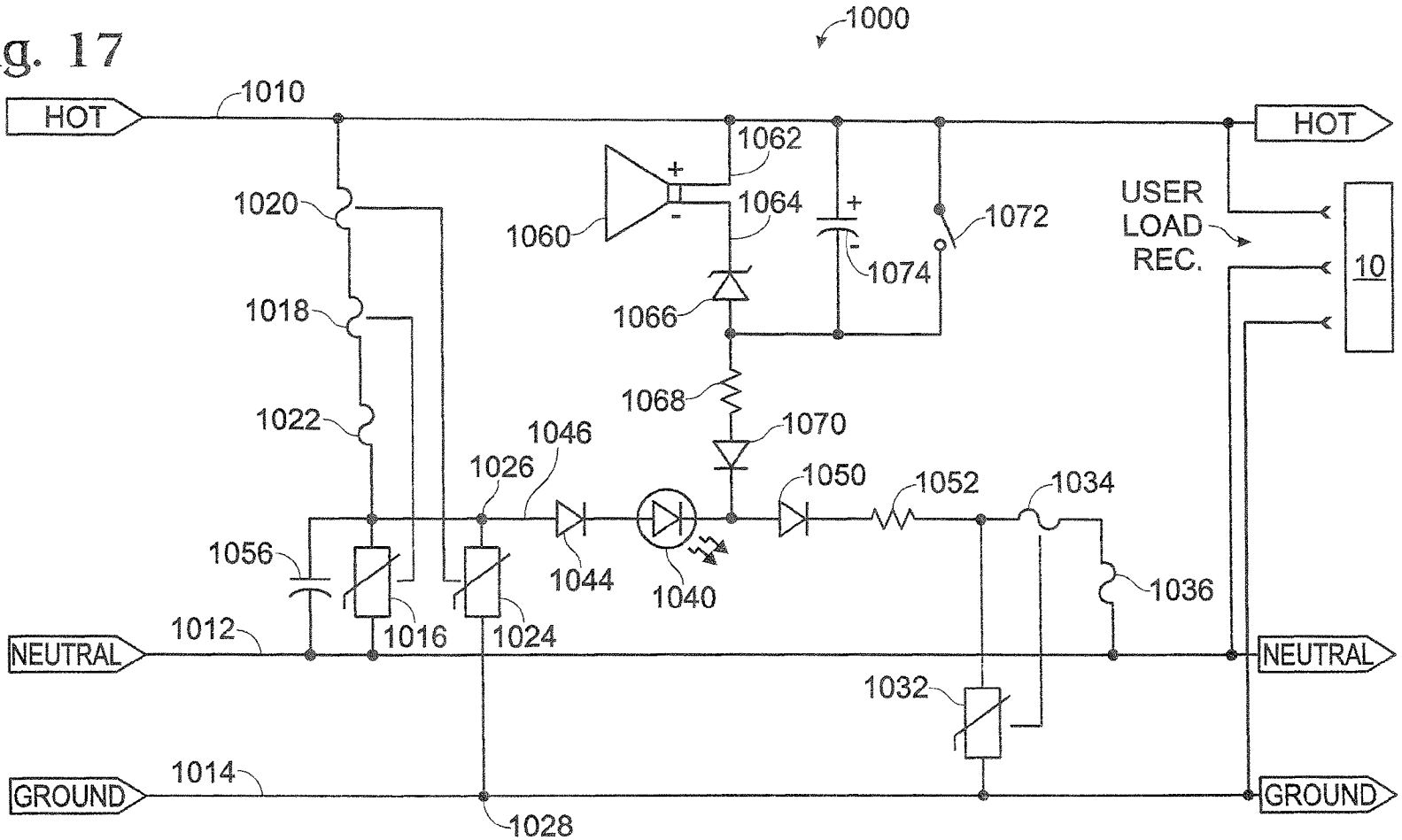
FIG. 17 is a schematic diagram of a TVSS electrical wiring device in accordance with an embodiment of the present invention.

FIG. 17 is a schematic diagram of a TVSS electrical wiring device in accordance with an embodiment of the present invention. A TVSS, also known as a surge protective device (SPD), protects wiring or a load from overvoltages that typically occur during lightning storms. TVSS 1000 is configured to protect a low voltage 120 VAC single phase electrical circuit. The circuit includes three conductors that, for convenience, are referred to herein as the hot 1010, neutral 1012, and ground 1014 conductors. The three conductors are disposed between line terminals disposed on the left side of the schematic and load terminals disposed on the right side of the schematic. The load terminals, in turn, are coupled to user accessible load receptacles. In accordance with the teachings of the present invention, the user accessible receptacles are protected by shutter assembly 10.

Transient voltages are known to occur between any pair of two of these conductors, and surge suppression devices, such as metal oxide varistors, are arranged to absorb transient voltage surges between any pair of the conductors. Fuses are provided for disconnecting the surge suppression devices from the circuit in the event of failure. Two specific failure modes are provided for, over current failure and temperature failure.

A first metal oxide varistor 1016, such as a 150 volt RMS metal oxide varistor is connected in series with a first thermally responsive fuse 18, a second thermally responsive fuse 1020, and a conventional over current fuse 1022, and the series combination is connected between the hot conductor 1010 and the neutral conductor 1012. A second varistor 1024 of the same type is connected at one end 1026 in series with three fuses just mentioned, and the other end 1028 is connected to the ground conductor. These two varistors protect the hot-neutral and hot-ground pairs. Each of the thermally responsive fuses 1018, 1020 is positioned physically close to one of the varistors 1016, 1024, so that a rise in temperature of the varistor, as would be caused by a failure, causes the adjacent fuse to open. Since the two thermally responsive fuses 1018, 1020 are connected in series, the thermal failure of either of the varistors will cause the connection of both varistors to the hot conductor to be broken.

A third metal oxide varistor 1032 is connected in series with another thermal fuse 1034, and an over current fuse 1036. The combination of the third varistor 1032 and the two fuses 1034, 1036 is connected between the neutral conductor 1012 and the ground conductor 1014. A thermal failure or an impedance failure of the third varistor device 1032 will cause one of the thermal fuse 1034 or the over current fuse 1036 to open, thereby disconnecting the varistor from the neutral-ground circuit.

A visible indicator, such as a light emitting diode 1040, is connected between the hot conductor 1010 and the neutral conductor, 1012 so that the light emitting diode 1040 is illuminated when all three of the varistors 1016, 1024, 1032 are functional, more particularly when none of the fuses 1018, 1020, 1022, 1034, 1036 is blown. A half wave rectifier diode 1044 has its cathode 1046 connected to the electrical conductor in series with the two thermal fuses 1018, 1020 and the over current fuse 1022, feeding the first two varistors 1016, 1024. The cathode of the rectifier diode 1044 is connected to one terminal of the light emitting diode 1040. The other terminal of the light emitting diode 1040 is connected through a blocking diode 1050 to a current limiting resistor 52, arranged in series, and then through the third thermal fuse 1034 and third over current fuse 1036 to the neutral electrical conductor 1012. A decoupling capacitor 1056 is preferably connected between the anode of the diode 1044 and the neutral conductor 1012.

When all of the fuses 1018, 1020, 1022, 1034 and 1036 are intact, that is when no fault has occurred, a circuit is created from the hot-conductor 1010 through the rectifier diode 1044, the light emitting diode 1040, the blocking diode 1050, the current limiting resistor 1052 and thence to the neutral conductor. The light emitting diode provides visible indication. If any of the three thermal fuses 1018, 1020, 1034 or two over current fuses opens 1022, 1036, the circuit is interrupted and the light emitting diode is extinguished, alerting a fault condition.

A TVSS 1000 in accordance with this invention also provides an audible indication of a fault in either of the varistors 1016, 1024 protecting the hot-neutral circuit or the hot-ground circuit respectively. A device, such as a simple buzzer 1060 or a piezoelectric device, has one terminal 1062 connected to the hot conductor 1010, and the other terminal 1064 connected by way of the series combination of a zener diode 1066, a current limiting resistor 1068, a first blocking diode 1070, second blocking diode 1050, second current limiting resistor 1052, the thermal fuse 1034, and the over current fuse 1036 to the neutral conductor 1012. The first and second thermal fuses 1018, 1020 and the first over current fuse 1022 are connected in series with rectifier diode 1044 and the light emitting diode 1040 between the hot electrical conductor 1010 and the junction of the two blocking diodes 1070, 1050 just mentioned, so that in normal operation no significant voltage passes through the buzzer, and the buzzer remains silent. If either of the varistors 1016, 1024 bridging the hot-neutral or hot-ground fails and any of the first and second thermal fuses 1018, 1020 and the first over current fuse 1022 is opened, voltage across the buzzer 1060 will cause it to sound.

In order to allow a user to deactivate the buzzer while awaiting repair, a normally open switch 1072 is connected effectively across the combination of the buzzer 1060 and the zener diode 1066. When the switch 1072 is closed, current through the buzzer 1060 is shunted through the switch and the buzzer is silenced. A capacitor 1074 is provided across the zener/audio alarm network to provide a DC voltage component to improve the audio alarm operating performance.

The buzzer deactivating switch 1072 is a simple normally open electrical switch, rather than a device that permanently deactivates the alarm 1060 or permanently interrupts a circuit trace. The switch 1072, once closed, can be opened at will and the buzzer 1060 reactivated. Accidentally deactivating the buzzer might destroy the audible alarm feature of the device permanently, and require its replacement even before it is installed. The use of a normally open switch in accordance with this invention eliminates this problem, and allows the alarm to be deactivated and reactivated.

Reference is made to U.S. patent application Ser. No. 11/531,588, which is incorporated herein by reference as though fully set forth in its entirety, for a more detailed explanation of TVSS wiring device.

Figure 18:
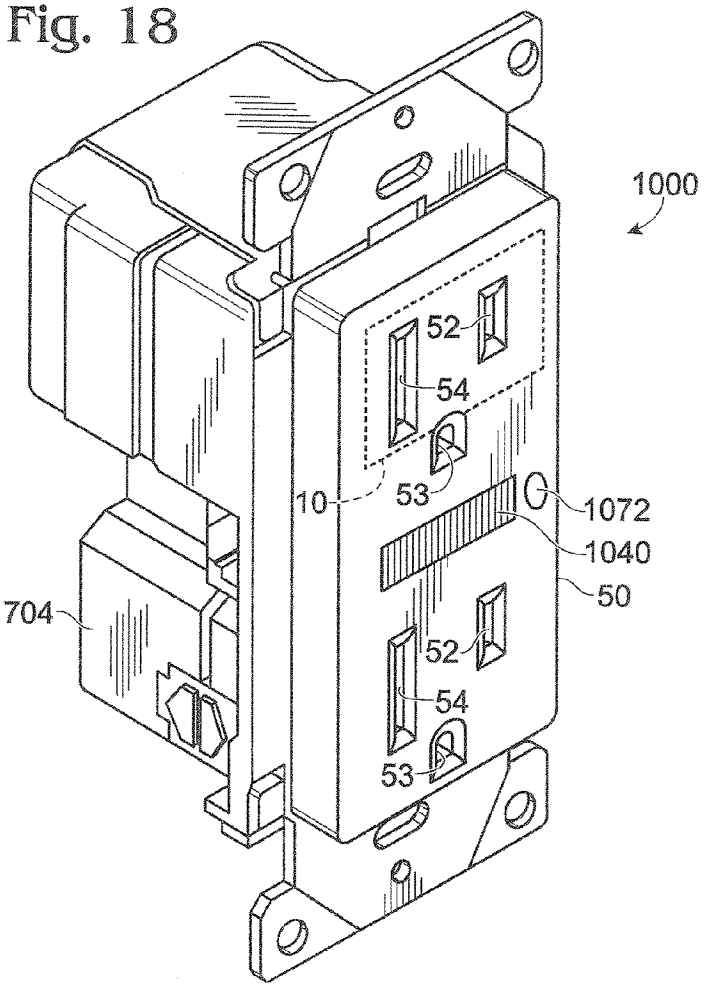
FIG. 18 is a perspective view of a TVSS receptacle in accordance with an embodiment of the present invention.

FIG. 18 is a perspective view of a TVSS receptacle in accordance with an embodiment of the present invention. TVSS receptacle 1000 includes a cover assembly 50 and rear housing 704, respectively, having cooperatively formed edge portions for mating engagement to provide an enclosed housing for the various components, as explained later. Cover assembly 50 includes front wall 51 having two sets of openings extending therethrough to receive the prongs of a standard form of male plug in conventional fashion. Each set of openings includes a hot receptacle opening 52, a neutral receptacle opening 54, and a ground receptacle opening 53. At least the hot receptacle opening 52 and the neutral receptacle opening 54 are protected by shutter assembly 10 (dashed lines) disposed within cover assembly 50 in the manner previously described. Also mounted in an opening in front wall 51, between the two sets of openings, is a lens for transmitting light emitted from LED 1040. Switch 1072 is disposed in another opening in front wall 51.

Figure 19:
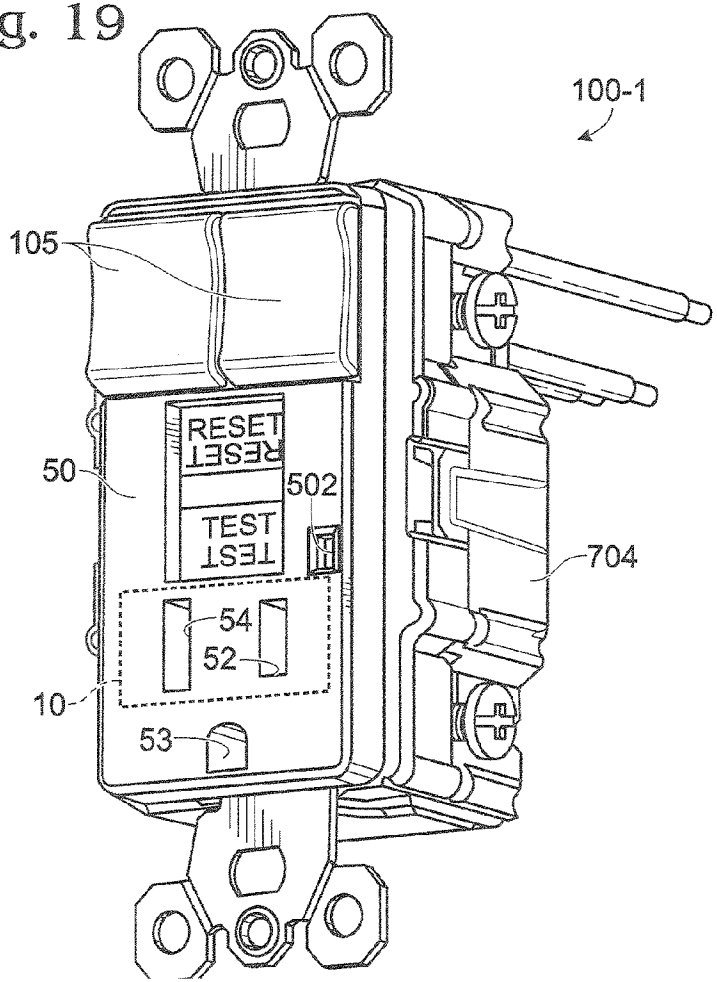
FIG. 19 is a perspective view of a GFCI receptacle and switch combination device in accordance with yet another embodiment of the present invention.

Referring to FIG. 19, a perspective view of a GFCI receptacle and switch combination device 100-1 in accordance with yet another embodiment of the present invention is disclosed. The GFCI receptacle includes hot receptacle opening 52 neutral receptacle opening 54, and ground receptacle opening 53. At least the hot receptacle opening 52 and the neutral receptacle opening 54 are protected by shutter assembly 10 (dashed lines) disposed within cover assembly 50 in the manner previously described.

In one embodiment, the GFCI receptacle is independent of the single pole switch 105. The load terminals of the GFCI receptacle may be electrically connected to the line terminals of the single pole switch 105. Thus, switch 105 is protected by the circuit protection components of GFCI 100-1. When GFCI 100-1 sense a fault condition, the GFCI trips in the manner described above, and no power is supplied to the switch 105. The electrical wiring device may further include a trip indicator 1314 mounted in and visible through the cover 50. The trip indicator 1314 may be implemented using an LED, a neon source, or other suitable light source.

Reference is made to U.S. patent application Ser. No. 10/994,662, which is incorporated herein by reference as though fully set forth in its entirety, for a more detailed explanation of a GFCI/Switch combination device.

Figure 20:
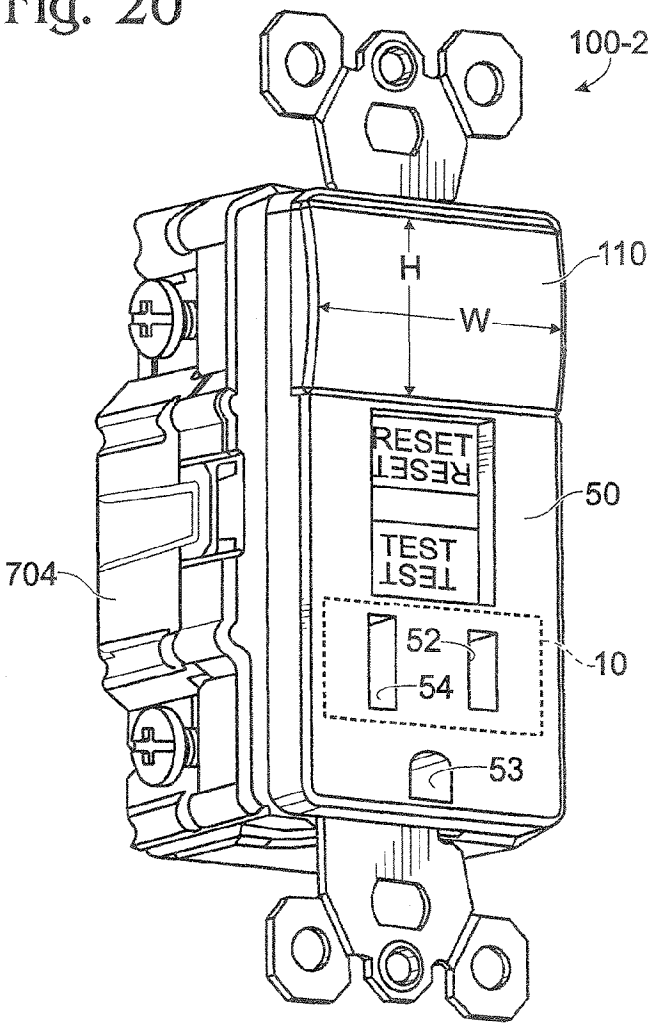
FIG. 20 is a perspective view of a GFCI receptacle and night light combination device in accordance with yet another embodiment of the present invention.

Referring to FIG. 20, a perspective view of a GFCI receptacle and night light combination device 100-2 in accordance with yet another embodiment of the present invention is disclosed. The electrical wiring device 100-2 is disposed within a housing 704 and front cover 50. The GFCI employed herein is similar to the GFCI disclosed in FIG. 13 and includes a single set of user accessible load receptacles. The receptacles include a hot receptacle opening 52 and a neutral receptacle opening 54, both of which are protected by shutter assembly 10, as indicated by the dashed lines.

The night light portion includes a lens cover 110. As those of ordinary skill in the art will appreciate, lens cover 110 may be fabricated using a clear or translucent material in accordance with factors such as light source type, emitted wavelength, desired light intensity, desired light diffusion characteristics, etc.

In one embodiment of the present invention, lens cover 110 may be removable to provide access to the light source. Lens cover 110 has a height (H) less than or equal to approximately 0.8 inch and a width (W) that substantially equal to the width of cover assembly 50.

Reference is made to U.S. patent application Ser. No. 10/998,369, which is incorporated herein by reference as though fully set forth in its entirety, for a more detailed explanation of a GFCI/Night Light combination device.

Figure 21:
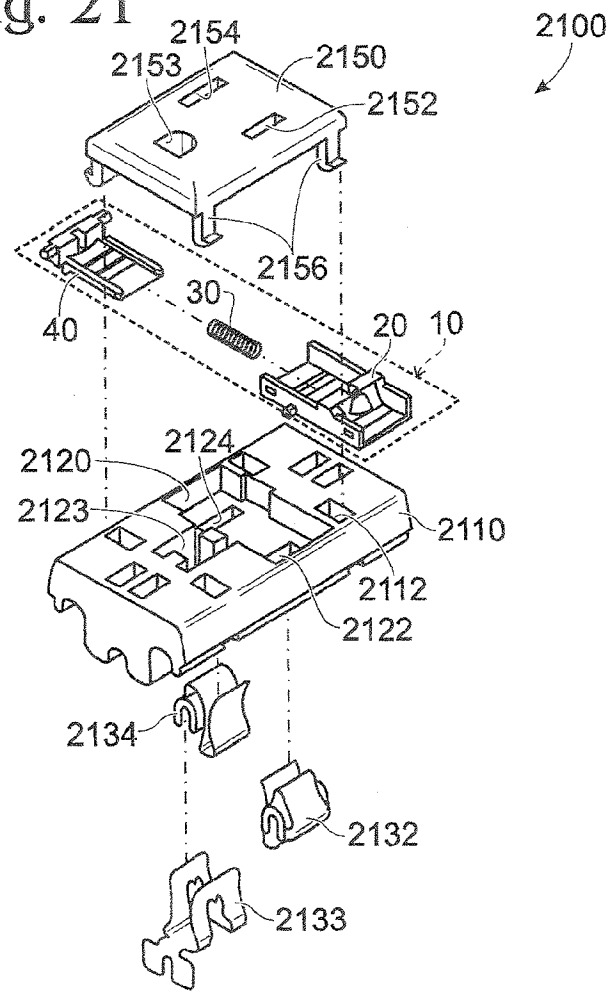
FIG. 21 is an exploded perspective view of a raceway structure in accordance with an embodiment of the present invention.

As embodied herein and depicted in FIG. 21, an exploded perspective view of a raceway structure 2100 in accordance with an embodiment of the present invention is disclosed. Raceway structures 2100 are configured for installation in an array of apertures disposed in a raceway housing (not shown). The raceway structures 2100 are oriented in the raceway housing by way of the apertures. Depending on the apertures, the longitudinal axes of structures 2100 are parallel to the width axis of the raceway housing, or they may be normal to the width axis. The raceway housing is made out of plastic or metal.

Raceway structure 2100 includes a cover member 2150 that is configured to mate with a body member 2110. Cover member 2150 includes snap-in members 2156 that are configured to mate with openings 2112 disposed in body member 2110. Cover member 2150 also includes receptacle openings 2152, 2153, and 2154, to accommodate the hot plug blade, ground plug blade and neutral plug blade, respectively, of a plug device.

The raceway body member 2110 includes a shutter registration pocket 2120. The shutter registration pocket 2120 includes a hot contact opening 2122 that is aligned with hot cover receptacle opening 2152. The hot contact opening is configured to receive hot contact 2132 therein. Pocket 2120 also includes a neutral contact opening 2124, the opening 2124 being aligned with neutral cover receptacle opening 2154. The neutral contact opening 2124 is configured to receive neutral contact 2134 therein. Pocket 2120 further includes a ground contact opening 2123 aligned with ground cover receptacle opening 2153. The ground contact opening 2123 is configured to receive ground contact 2133 therein.

As its name suggests, the shutter registration pocket 2120 is configured to accommodate protective shutter assembly 10 (shown in an exploded view in FIG. 21). Accordingly, shutter assembly 10 is disposed between the cover member 2150 and contacts (2132, 2133, 2134) and prevents an object inserted in receptacle opening 2152 from engaging contact 2132 or an object inserted in receptacle opening 2154 from engaging contact 2134 unless those objects happen to be the hot plug blade and the neutral plug blade of a plug device.

Figure 22:
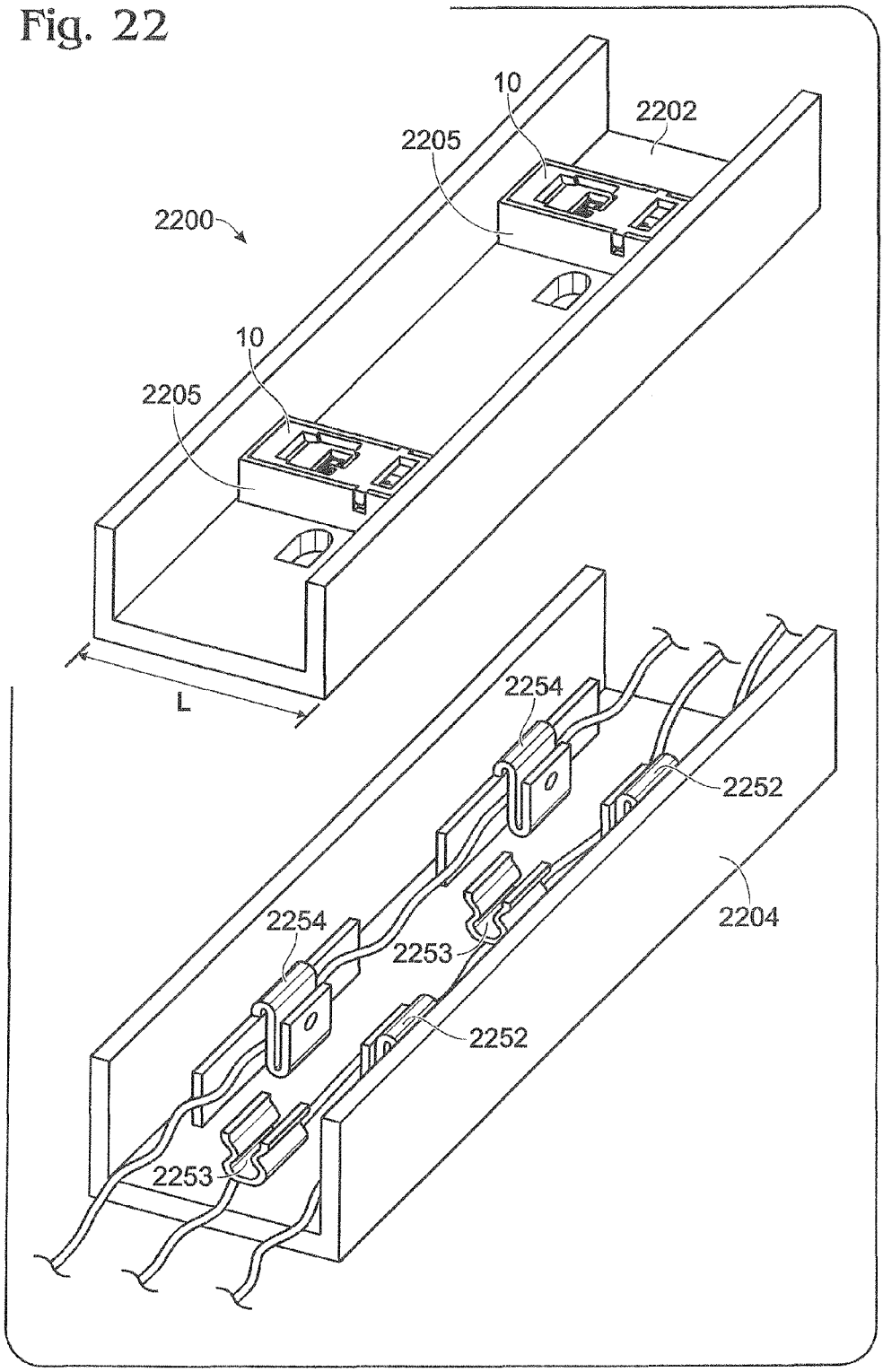
FIG. 22 is an exploded perspective view of a raceway structure in accordance with another embodiment of the present invention.

As embodied herein and depicted in FIG. 22, an exploded perspective view of a raceway structure 2200 in accordance with another embodiment of the present invention is disclosed. The raceway structure includes an elongated top portion 2202 and an elongated base portion 2204. The top portion 2202 includes registration members 2205 that are configured to register and align shutter assembly 10 in the correct position within top portion 2202.

The bottom portion 2204 also includes registration members (not shown for clarity of illustration) spaced at appropriate positions along the longitudinal axis of the bottom portion 2204. The bottom registration members are configured to receive hot contact 2252, neutral contact 2254, and ground contact 2253 at each position along the longitudinal axis of the bottom portion 2204. Of course, those of ordinary skill in the art will understand that these positions are aligned with the locations of the receptacle openings formed in top portion 2202.

The raceway structure 2200, therefore, is assembled by coupling the top portion 2202 to the bottom portion 2204 such that a shutter assembly 10 is disposed between each set of receptacle openings disposed in the upper portion 2202 and a corresponding set of contacts disposed in the lower portion 2204.

Raceway structure 2200 commonly has an interior width dimension denoted in FIG. 22 as dimension "L." Since dimension L is typically about 1.00 inch, the length dimension of the frameless shutter assembly 10 (previously noted as about 0.86 inches) is readily accommodated. Referring back to the embodiment shown in FIG. 21, the length axis of the frameless shutter assembly plus an allowance for the thickness of the walls surrounding pocket 2120 are likewise accommodated within dimension L.

A multiple outlet strip (MOS) is similar to raceway except that it is typically shorter in length. It may be provided with an electrical plug and its receptacle outlets may be more tightly clustered in a row or even disposed in more than one row. Despite these differences, the receptacle outlets in an MOS can be configured to include the shutter mechanism assembly such as in the manners described for raceway.

Figure 23:
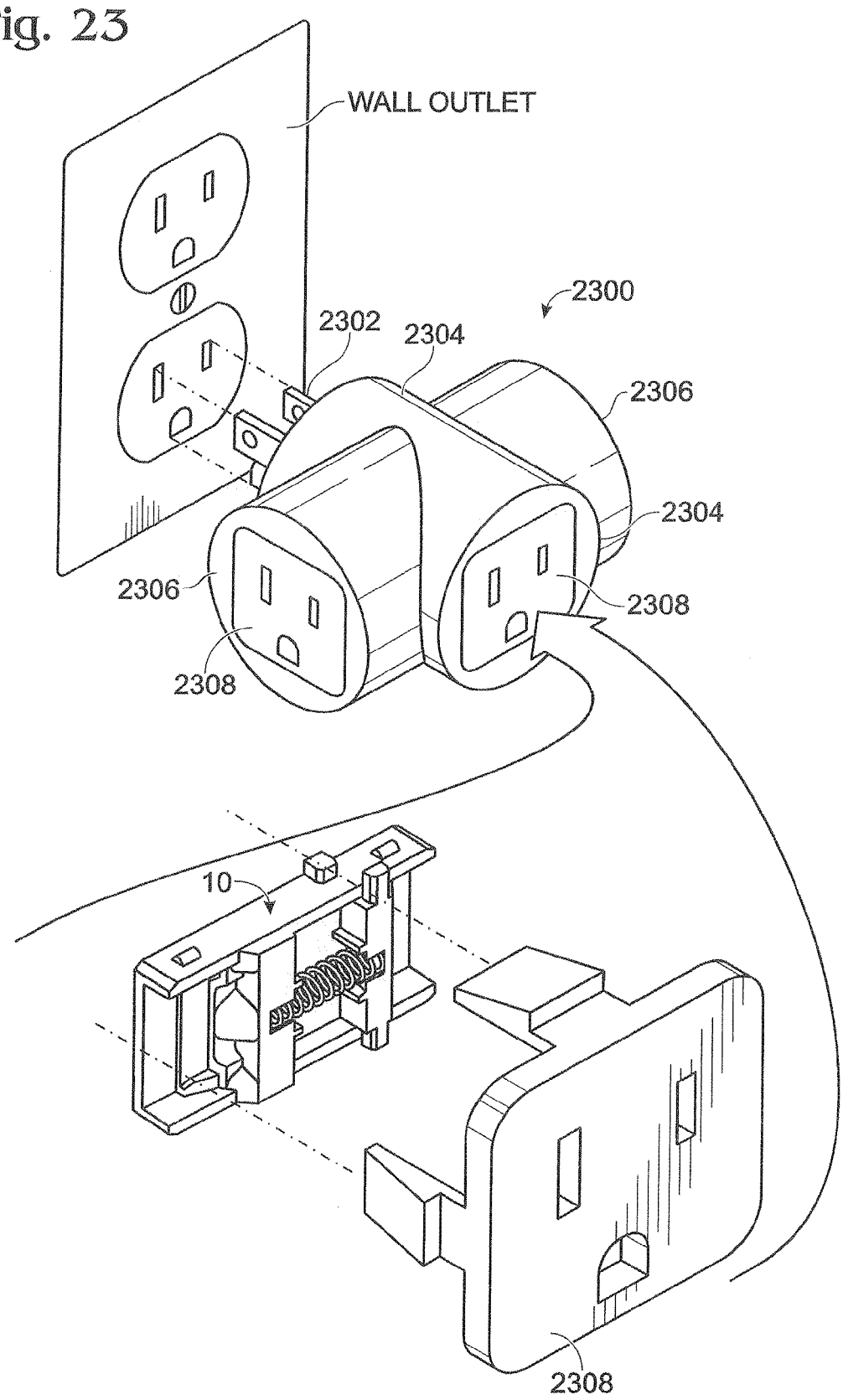
FIG. 23 is a perspective detail view of a power adapter receptacle in accordance with another embodiment of the present invention.

Referring to FIG. 23, a perspective detail view of a power adapter receptacle in accordance with another embodiment of the present invention. In this embodiment, adapter 2300 includes a set of male contact blades 2302 that are configured to be inserted into a standard wall socket. The male contact blades are electrically coupled to three sets of female contacts, i.e., one set of female contacts (not shown) disposed in each of the main barrel 2304 and side barrels 2306. The female contact sets are accessible to the user via a cover plate 2308 in the manner shown. The shutter assembly 10 of the present invention is disposed between cover 2308 and the set of female contacts.

Figure 24:
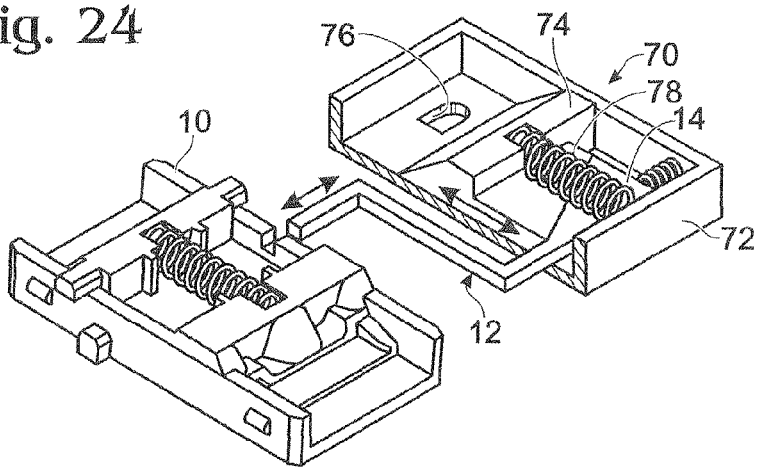
FIG. 24 is a perspective view of a ground blade shutter assembly in accordance with the present invention.

As embodied herein and depicted in FIG. 24, a perspective view of a ground blade shutter assembly 70 in accordance with the present invention is disclosed. In this embodiment, ground shutter 70 is coupled to protective shutter 10 by a lockout arm 12. Ground shutter 70 includes a base member 72 configured to accommodate slide shutter 74 and shutter spring member 78. Base member 72 has a shutter blade opening 76 formed therein. Lockout arm 12 includes a drive cam 14. Slide shutter 74 drives cam 14 from a locked to an unlocked position. A return spring 79 (not shown in this view for clarity of illustration) is disposed between drive cam 14 and a sidewall of base member 72.

Ground shutter assembly 70 is configured to snap into a registration pocket (not shown for clarity of illustration) disposed inside the front cover 50 of the receptacle. The registration pocket aligns the ground shutter blade opening 76 with the ground receptacle opening 53 (See FIG. 5 and FIG. 6) in cover 50. In FIG. 24, ground shutter 70 is open.

The ground blade shutter affords several benefits. When a ground blade is not present, shutter 70 is in the closed position such the slide shutter 74 blocks ground shutter blade opening 76. One benefit is that ground shutter 70 prevents contaminants, insects and other such undesirable materials from entering the wiring device. Another benefit is that when a ground blade is not present, the hot and neutral shutters in shutter assembly 10 are locked in the closed position by lockout arm 12. Lockout is maintained even if there is an attempt to insert an electrical plug having hot and neutral blades. This prevents an ungrounded plug (or a plug with a missing ground blade) from receiving electrical power.

Figure 25A:
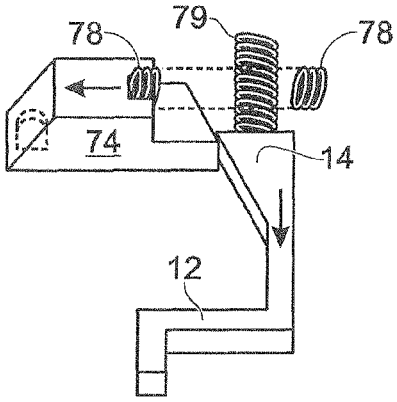
FIGS. 25A-D are detail views of the ground blade shutter assembly depicted in FIG. 24.

Referring to FIGS. 25A-D, detailed operational views of the ground blade shutter assembly depicted in FIG. 24 are shown. The ground shutter assembly 70 operates as follows. Referring to FIG. 25A, slide shutter 74 is biased to the left (closed) by the ground shutter spring 78 until a ground prong of a plug is inserted. In the view of FIG. 25A, those of ordinary skill in the art will understand that a portion of spring 78 is cut-away for clarity of illustration.

Figure 25B:
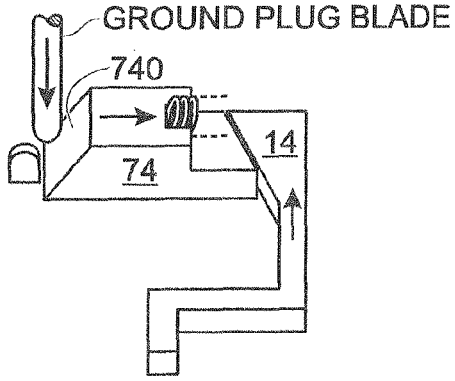

As shown in FIG. 25B, as the ground prong pushes downward against the ramped surface 740, the slide shutter 74 is moved towards the right, compressing spring 78 (not shown in this view). The ground prong continues to move downward until it passes through ground shutter blade opening 76 to make electrical contact with a ground contact disposed underneath ground shutter assembly 70.

Figure 25C:
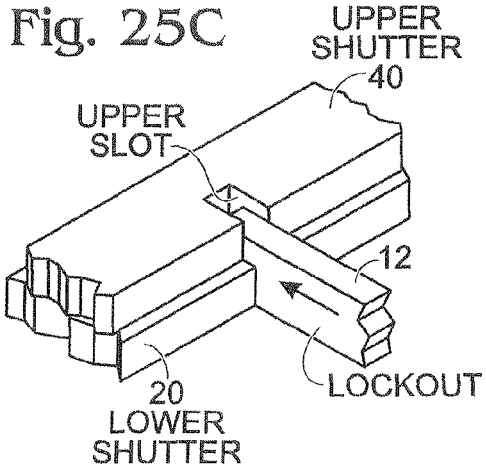

Referring to FIG. 25C, lockout arm 12 decouples the ground shutter assembly 70 from the protective shutter assembly 10. In this embodiment, the frameless shutter assembly 10 includes slots in the upper and lower rails (22, 42) which accommodate lockout arm 12. Note that lower shutter 20 and upper shutter 40 cannot move relative to each other when lockout arm 12 is disposed in the upper and lower slots. Thus, the protective shutter 10 is "locked out" and cannot move from the closed position to the open position in response to the insertion of an electrical plug unless the electrical plug includes a ground plug, i.e., a ground prong is inserted first.

Referring back to FIGS. 25 A-C, slide shutter 74 has a diagonal edge that is configured to engage the diagonal edge of the drive cam 14. When the slide shutter 74 is moved to the right by the ground prong, slide shutter 74 bears against drive cam 14 which compresses the return spring 79. The force applied by the slide shutter removes the lockout arm 12 from the upper and lower slot.

Figure 25D:
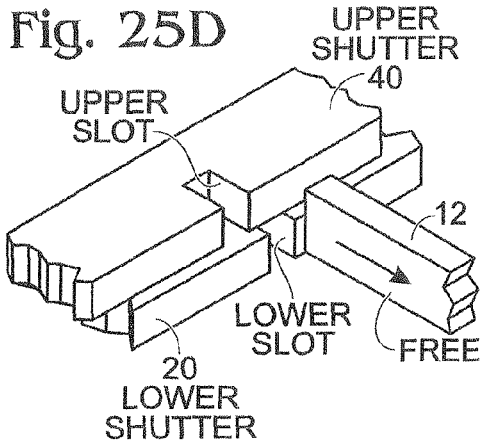

Referring to FIG. 25D, the lower shutter 20 and the upper shutter 40 are freed and are able to move from the closed position to the open position in response to the insertion of the hot and neutral blades of the plug. When the plug is removed, all of the shutters (hot, neutral, and ground) return to their closed positions. Lockout arm is also re-inserted into the upper and lower slots. The process repeats itself when a plug is re-inserted into the wiring device.

A ground blade shutter may be particularly useful in duplex receptacles having an isolated ground configuration. The aforementioned isolated ground configuration refers to a receptacle device having mounting straps that are electrically isolated from the ground contacts.

Figure 26:
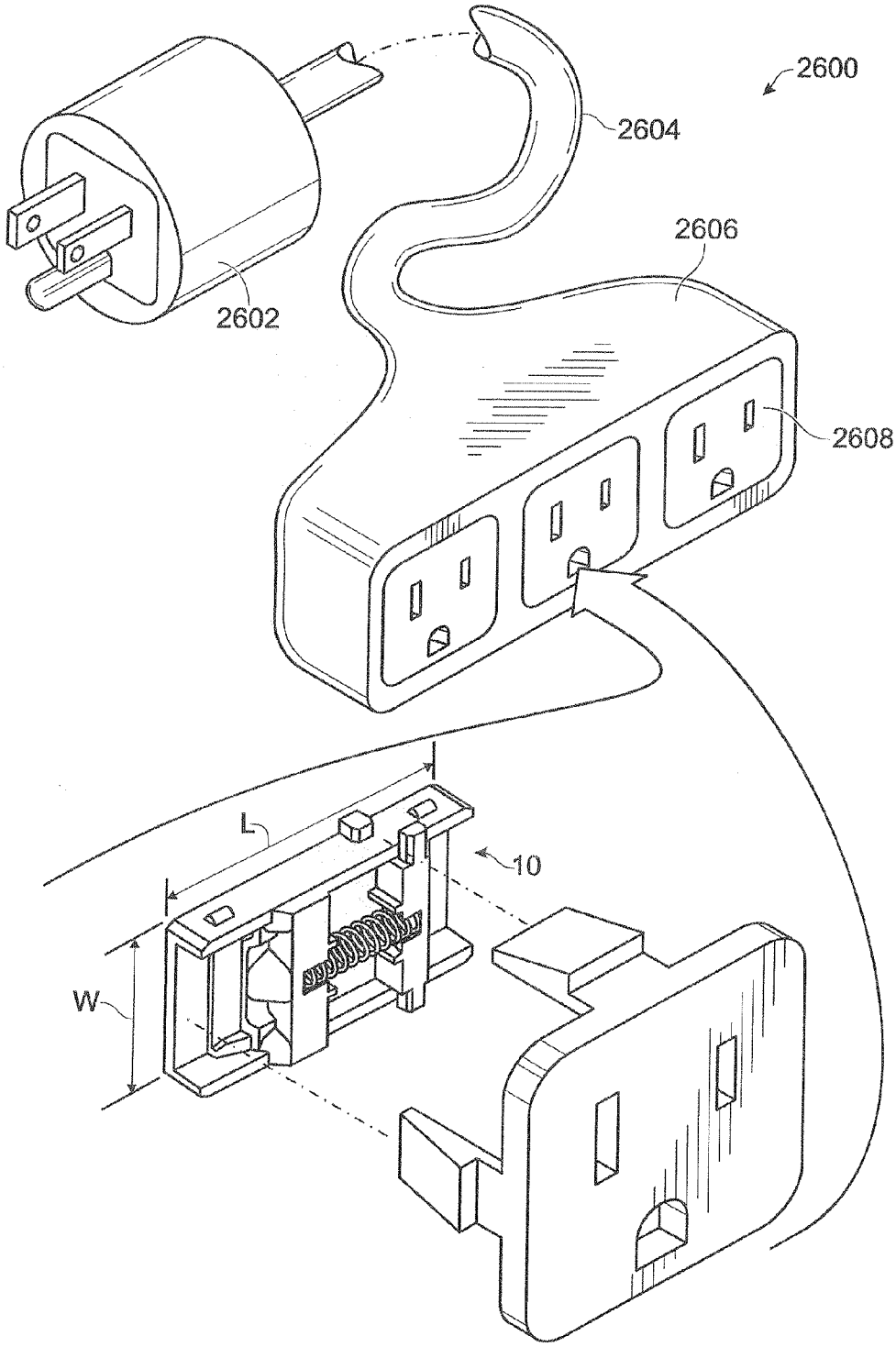
FIG. 26 is a perspective detail view of an extension cord device in accordance with another embodiment of the present invention.

Referring to FIG. 26, a perspective detail view of an extension cord device in accordance with another embodiment of the present invention is disclosed. In this embodiment, adapter 2600 includes a male plug connector 2602 that is configured to be inserted into a standard wall socket. The male contact blades are electrically coupled to three or more sets of female contacts disposed in head connector portion 2606 by way of wire 2604. The female contact sets are accessible to the user via a cover plate 2608 in the manner shown. The shutter assembly 10 of the present invention is disposed between cover plate 2608 and the set of female contacts disposed in head 2606. Those of ordinary skill in the art will appreciate that the compact nature of shutter assembly enables the head connector to include three or more user accessible outlets. As noted previously, in a 15 A rated receptacle, the length (L) is approximately 0.860 inches or less, the width (W) is approximately 0.460 inches or less, and the thickness of the shutter assembly is approximately 0.170 inches or less. Accordingly, the width of the connector head 2606 (for three outlets) may be substantially less than one-half (0.5) inch.

Figure 27:
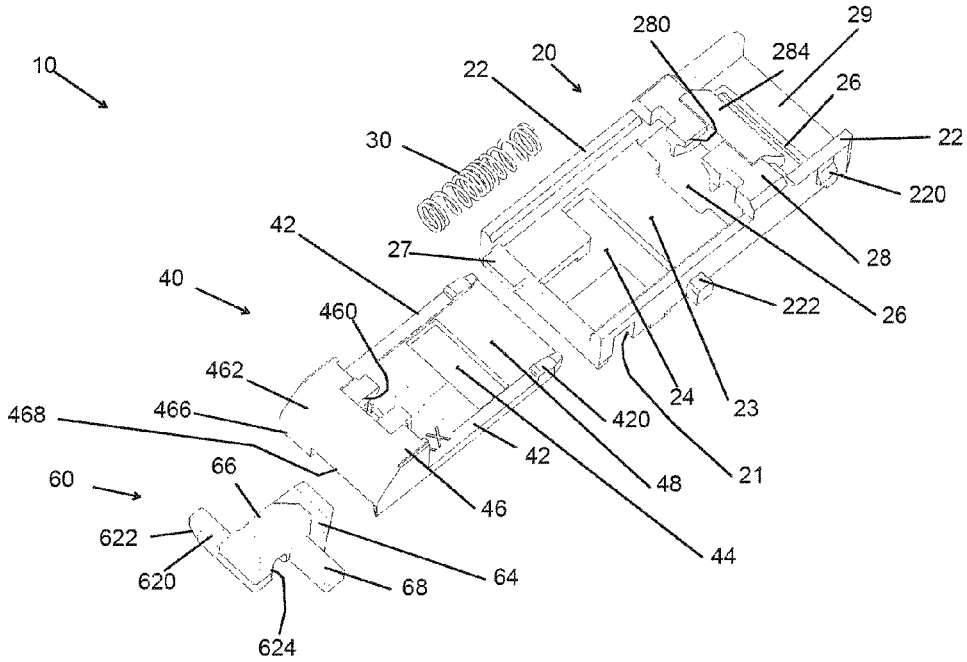
FIG. 27 is an exploded view of a protective shutter assembly in accordance with yet another embodiment of the present invention.

As embodied herein and depicted in FIG. 27, an exploded view of a protective shutter assembly 10 in accordance with yet another embodiment of the present invention is disclosed. Like the embodiment shown in FIG. 9, this embodiment is directed to a shutter assembly that may be employed in a 20 A wiring device. The neutral receptacle opening for the 20 A outlet receptacle may be in the shape of a so-called T-slot (see, e.g. FIG. 33) so that either 15 A plugs or 20 A plugs may be inserted. In this embodiment, many of the same concepts previously discussed are embodied herein. The improved features relate to shutter mechanism 60.

The 20 A protective shutter assembly 10 is a frameless mechanism that includes a lower shutter member 20 and an upper shutter member 40. A spring member 30 is disposed between lower shutter 20 and upper shutter 40.

The lower shutter 20 includes side rails 22 and a base member 23 disposed therebetween. Base 23 has a first hot contact aperture 26 and a neutral contact aperture 24 formed therein. Aperture 24 is shaped as a T-shaped aperture to be able to accommodate either a 15 A or 20 A plug when the shutter assembly is in the open position. The base portion of the T-slot receptacle opening 24, which extends along the longitudinal axis of lower shutter member 20, extends to an end rail that includes a lower locking member 27 which extends outwardly therefrom. Side rail 22 also includes a notched region 21 which is configured to accommodate a portion of the 20 A shutter. A transverse hot blade contact structure 28 is disposed between rails 22 and spans a portion of the first hot contact aperture 26. Transverse contact structure 28 includes a spring retainer pocket 280 and blade contact ramp 284. Those of ordinary skill in the art will recognize that this embodiment could easily be implemented in accordance with the embodiment depicted in FIG. 9 by including the blade detection geometry implemented by hot blade contact ramp 284 and ramp base 286.

The upper shutter member 40 includes guide rails 42 having a base member 48 disposed therebetween. As noted above, the guide rails 42 include a stop member 420 that is configured to abut lower shutter rail guides to prevent the shutters (20, 40) from disengaging due to the force exerted by the spring 30. An upper shutter hot contact aperture 44 is disposed in base member 48. Upper shutter member 40 also includes a transverse neutral blade contact structure 46 disposed at one end thereof. Transverse neutral blade contact structure 46 includes a spring retainer pocket 460 and ramp 462. Like the lower shutter transverse contact structure 28, a blade detection geometry may be implemented in accordance with the neutral blade contact ramp 462 and ramp base 465 depicted in the embodiment of FIG. 9. The ramp 462 includes a shutter stop portion 466 and a shutter insertion guide region 468.

The 20 A shutter member 60 includes an upper locking member 620, a tooth portion 64, ramp portion 66 and positioning tab 68. The locking member 620 includes a cammed surface 622 and a guideway 624.

Figure 28:
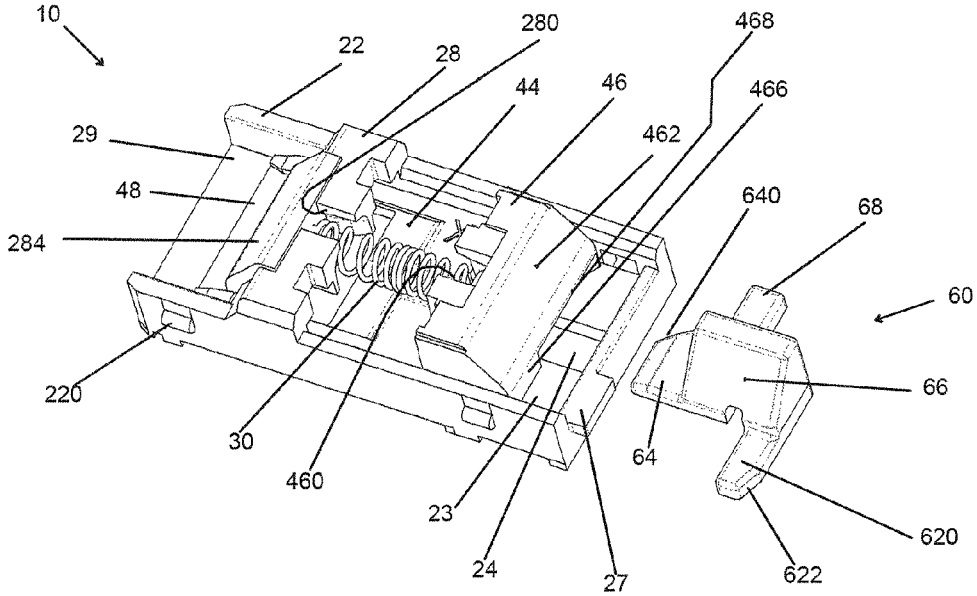
FIG. 28 is a perspective view of the partially assembled protective shutter assembly shown in FIG. 27.

Referring to FIG. 28, a perspective view of the partially assembled protective shutter assembly shown in FIG. 27 is disclosed. In this view, the lower shutter 20 and the upper shutter 40 are interconnected. The 20 A shutter is shown adjacent the side of the lower shutter to which it is mated. The upper locking member 620 includes a guideway 624 that is configured to fit over the end rail of lower shutter 20 and under lower locking member 27. Tooth portion 64 is designed to fit under ramp 462. The relatively straight edge of tooth portion 64 abuts the shutter stop portion 466. The cammed tooth portion 640 mates with a cammed surface 469 disposed in the shutter insertion guide region 468 under ramp 462. When the shutter 60 is moved, the cammed tooth portion 640 presses against cammed surface 469 to cause the upper shutter to move as well. Positioning tab 68 is configured to be inserted into the notched region 21 of side rail 22. Shutter 60 is employed to block a portion of the T-slot receptacle opening 24 in the closed position.

Figure 29A:
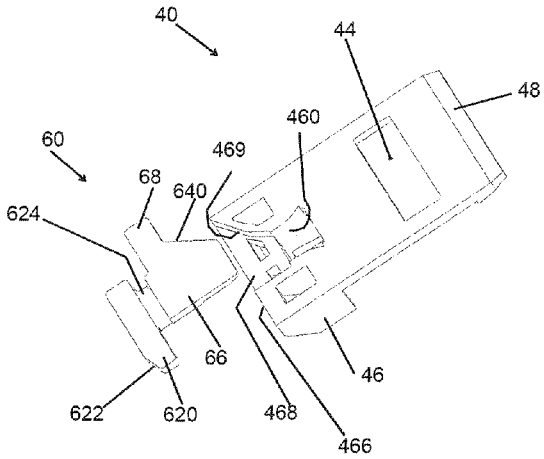
FIG. 29A-B are perspective views of a portion of the protective shutter assembly shown in FIG. 27.
Figure 29B:
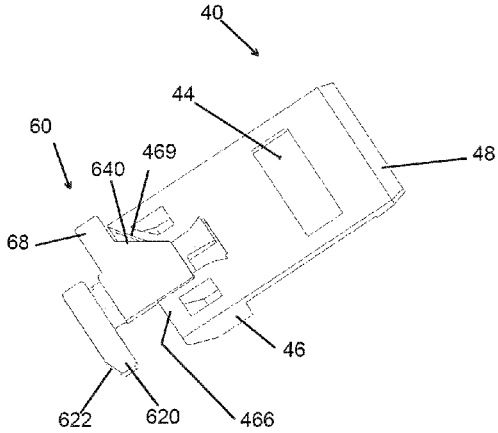

Referring to FIGS. 29A-B, perspective views of a portion of the protective shutter assembly shown in FIG. 27 are disclosed. In particular, the underside of upper shutter 40 is shown relative to 20 A shutter 60. In the view shown herein, the shutter insertion guide region 468 includes a cammed surface 469 that substantially conforms to the cammed surface 640 of tooth portion 64 such that tooth portion 64 is accommodated within region 468. Region 468 is a shutter interface and functions in an analogous way to the slot 25 depicted in FIG. 9. Note that the bottom surface of upper shutter 40 and the bottom surface of 20 A shutter 60 are substantially flush relative to the surface of the base 23 of lower shutter 20.

As has been shown, cammed surface 469 consists of two ramps. Ramp 469*a* starts the travel of the 20 A shutter back to the closed position whereas ramp 469*b* finishes the movement of the 20 A shutter to the closed position. If the cam were to have only ramp 469*b*, its steep angle would cause the 20 A shutter to stall out and not start camming to the closed position. On the other hand if the cam were to have only ramp 469*a*, its shallow angle would prevent the cam from interfacing with tooth member 64 to fully close the 20 A shutter. Extending the cam outward to reach the tooth member would not be a solution since the shutter would then not open when a 20 A plug was inserted. Thus the two ramps assure that the shutter moves between the open and closed positions as intended for small plug blade geometries such as the 20 A geometry. In another embodiment, the cammed surface can be a non-linear shape that achieves the same objectives as the two ramps. The non-linear shape may include curved portions or multiple-segmented portions.

Figure 30A:
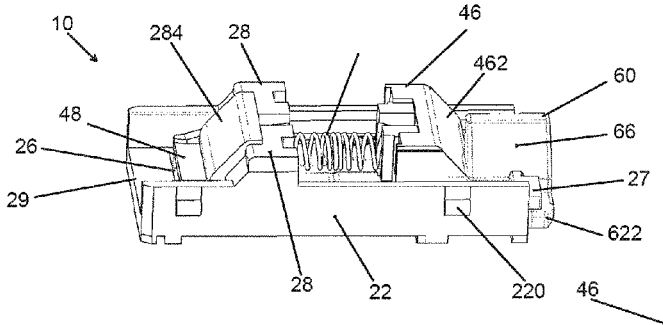
FIG. 30A-30B are perspective views of the protective shutter assembly shown in FIG. 27.
Figure 30B:
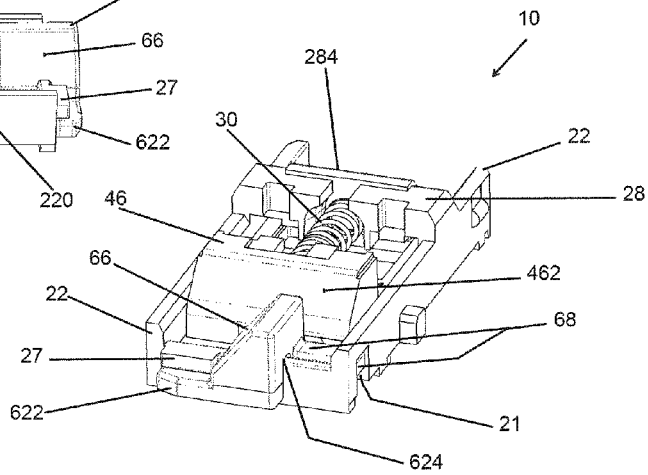

Referring to FIGS. 30A-30B, perspective views of the protective shutter assembly shown in FIG. 27 are disclosed. These views show the fully assembled shutter 10. From FIG. 30B, it is seen that guideway 624 allows 20 A shutter 60 to glide from side-to-side over the end rail portion of lower shutter 20. The movement of shutter 60 is limited at one end by upper locking member 27 which abuts shutter ramp 66. As shutter 60 glides to the other side of the shutter 10, the positioning tab 68 extends outwardly from the side rail 22 via notch opening 21. The movement of shutter 60 is limited at this end by the vertical side of ramp 66 abutting the interior edge of side rail 22. Shutter 60 moves in this direction when the T-shaped prong of a 20 A plug is inserted into the neutral plug opening 54 (not shown in this view). The 20 A neutral plug prong is pressed against ramp 66.

During manufacturing assembly, upper shutter 40 and lower shutter 20 are fastened together by way of rail stop members 420. See, e.g., FIG. 27. Next, spring 30 is inserted into retainer pockets (280, 460.) The upper shutter is then slid within side rails 22 so as to compress spring 30. While the spring is compressed, the positioning tab 68 of 20 A shutter member 60 is inserted in notch opening 21 of lower shutter 20. Shutter member 60 is then pivoted upwardly until upper locking member 27 of lower shutter 20 engages locking member 620 in a snap fit. The upper shutter is then released and allowed to slide back. Even though tooth member 64 is then sandwiched between ramp 468 and base portion 23, shutter 60 is still slidable with respect the shutters (20,40.) As such, there is a completed assembly that includes three shutters that are slidable with respect to each other and that do not rely on an external housing or a frame for holding the assembly together. Further, the assembly includes one spring. When this spring is in its relaxed state, the three shutters are in the closed position. Although one assembly sequence has been described, others are possible and within the spirit of the invention. For example, shutter 60 is attached to lower shutter 20 before upper shutter 40 is attached to lower shutter 20. The shutter mechanism assembly is economical because it universally accommodates a plurality of plug blade configurations. In other words, the manufacturing benefits from standardization outweigh the costs of the extra parts in the assembly that would be superfluous to certain plug configurations. As such, it would be advantageous to include a 20 A shutter in a 15 A receptacle even though the 15 A receptacle openings prevent the shutter from ever being accessed. Although the receptacle opening prevents the 20 A shutter from being used, the interior of the 15 A front cover is configured to physically accommodate the 20 A shutter.

Figure 31:
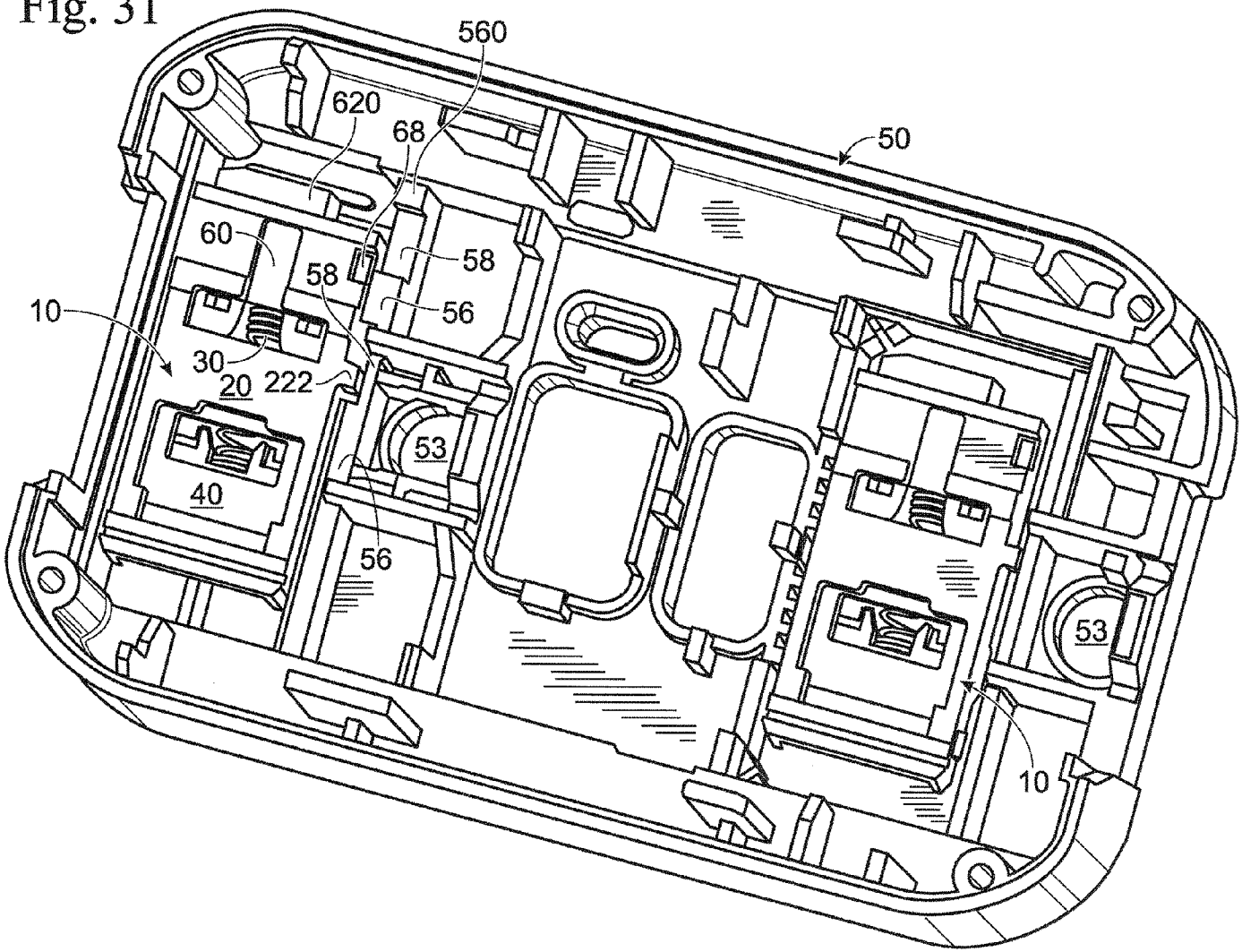
FIG. 31 is a perspective view of a GFCI cover assembly with the protective shutter assembly shown in FIG. 27 disposed therein.

Referring to FIG. 31, a perspective view of an interior portion of GFCI cover assembly 50 with the protective shutter assembly shown in FIG. 27 disposed therein is disclosed. The discussion provided above with respect to FIG. 5 is applicable here as well. The difference between the embodiment of FIG. 5 and the embodiment of FIG. 31 relates to the differences between the 15 A embodiment and the 20 A embodiment. Cover assembly 50 includes several registration ribs that include cover registration structures 560 (See, e.g., FIG. 5), and registration alignment keys 58 disposed therein. The registration structures 560 accommodate alignment snaps 220 formed in the lower shutter member 20. An alignment key 58 may accommodate a lower shutter longitudinal registration member 222 or the positioning tab member 68 of the 20 A shutter. The position of alignment key 58 ensures that the protective shutter assembly 10 is positioned within cover assembly 50 such that the hot aperture 26, neutral aperture 24, and the ramp structures (284, 462) and base portions (23,48) are correctly aligned with the receptacle openings (52, 54). One of the alignment keys plays a role in the locking functionality of the 20 A shutter as well.

Figure 32A:
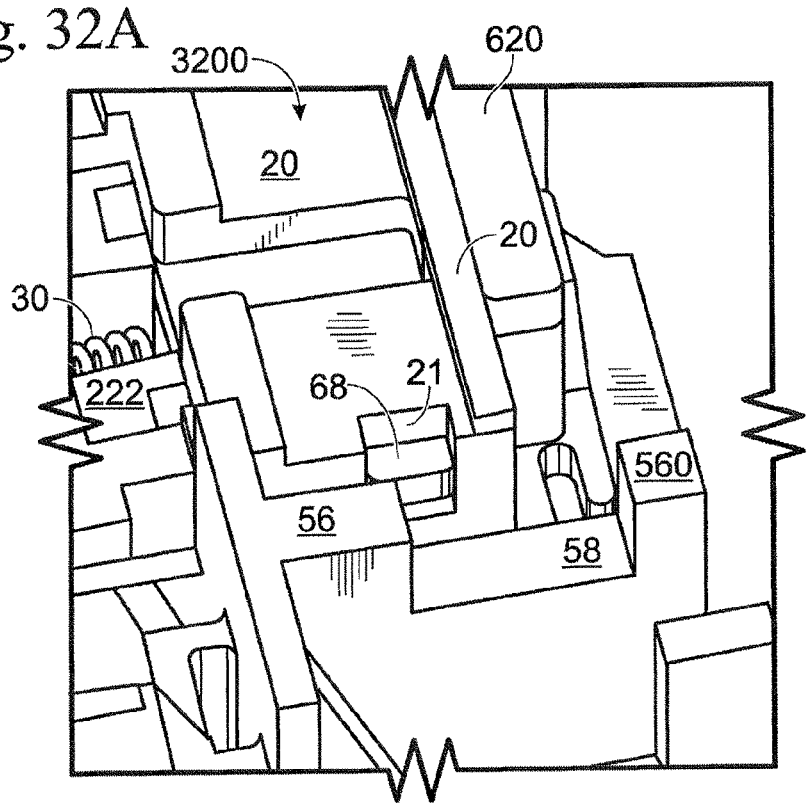
FIG. 32A-B are detail views of the GFCI cover assembly and the protective shutter assembly shown in FIG. 27.
Figure 32B:
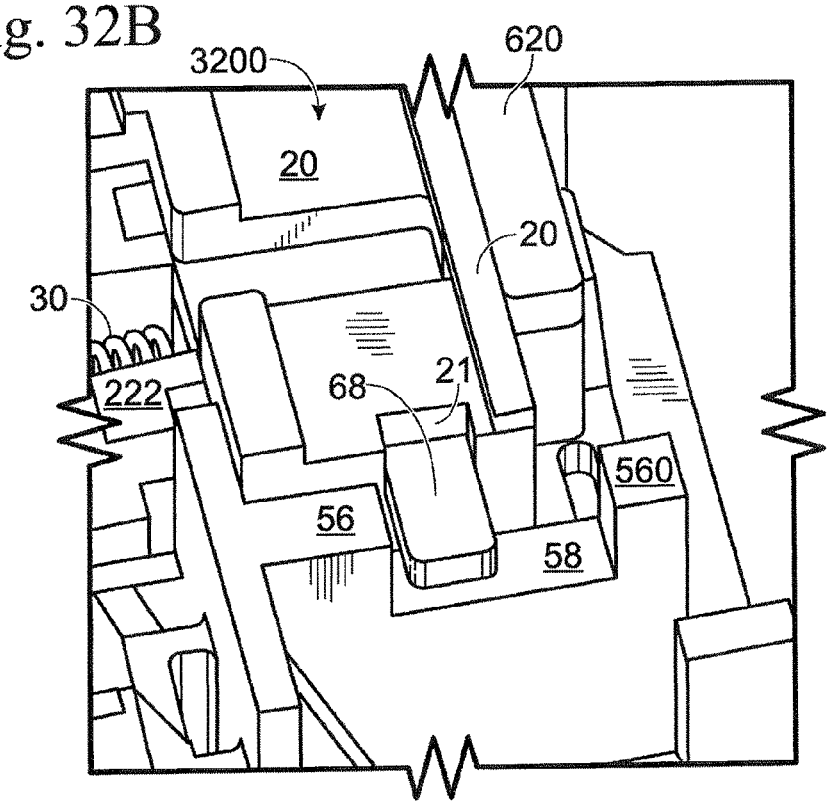

Referring to FIG. 32A-B, detail views 3200 of the 20 A locking functionality are disclosed. In FIG. 32A, the 20 A shutter 60 is prevented from opening by restricting the movement of the positioning tab 68. As noted above, the positioning tab 68 of the 20 A shutter assembly 60 extends from the notched region 21 of side rail 22. In FIG. 32A, the movement of the positioning tab 68 is inhibited by the horizontal portion of the registration rib structure 56. Note also the gap between the lower shutter longitudinal registration member 222 and the vertical portion of rib structure 56. Accordingly, when a probe or some other foreign object is inserted only into the 20 A portion of the t-slot opening 54, the positioning member will be impeded by rib structure 56 and the shutter is unable to open. Since the shutter 10 remains closed, the foreign object will be prevented from contacting the electrical receptacle contacts.

On the other hand, when a 20 A plug connector blade is properly inserted into the hot and neutral blade openings, the shutter assembly will be directed from the closed position to the opening position. Upon insertion of the 20 A plug, the hot blade and the neutral blade structure of the 20 A plug are pressed against ramp 284 and ramp 462, respectively. This action will cause the ramps (284, 462) to move toward each other such that spring member 30 is compressed. In the view provided in FIG. 32A, the motion causes the lower shutter 20 to move to the right. The combination of the registration rib and the alignment key 58 function as a stationary alignment structure within the cover 50. At some point, the positioning tab 68 clears the registration rib 56 and is allowed to extend into the alignment key 58. As the connector plug blades are inserted further into the openings, a portion of the neutral blade makes contact with ramp 66 on shutter 60 and the shutter 60 opens because positioning tab 68 is no longer impeded by the rib structure 56. The shutter member 20 is configured such that the upper shutter 40 slides within, permitting the 20 A neutral blade to be inserted into the neutral opening.

Figure 33A:
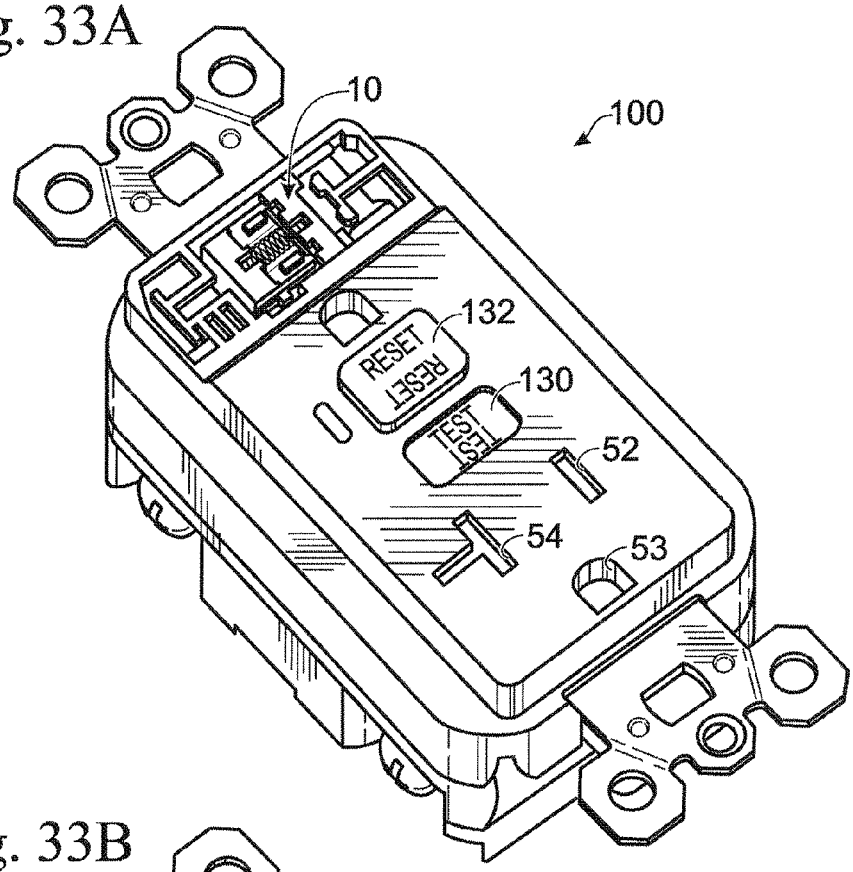
FIG. 33A-B are perspective views of a GFCI incorporating the protective shutter assembly shown in FIG. 27.
Figure 33B:
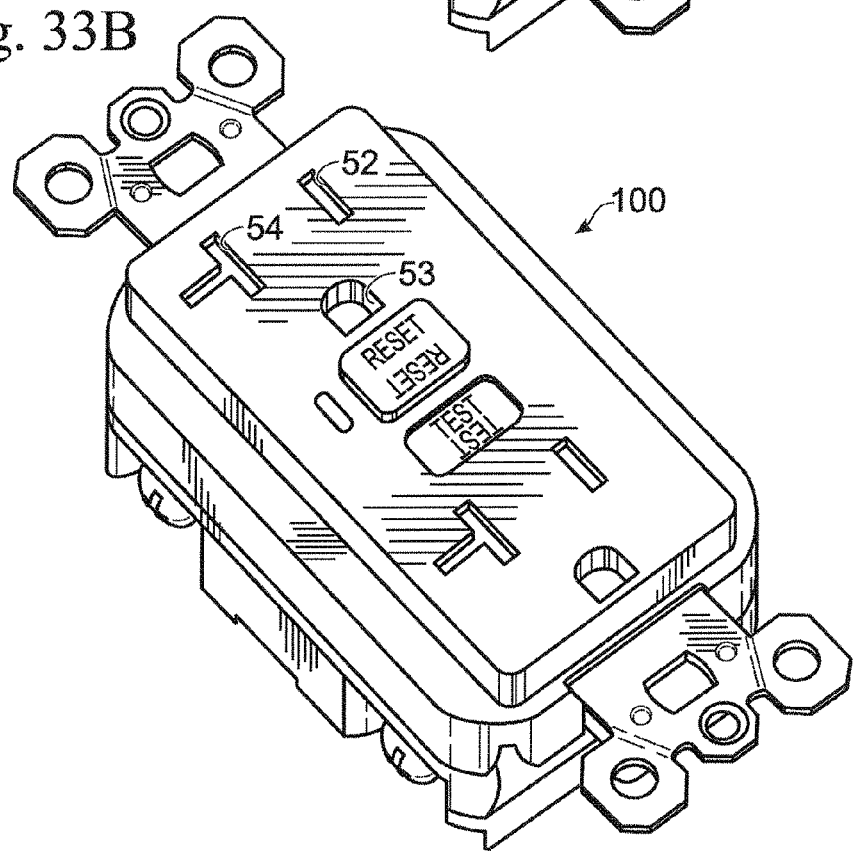

Referring to FIG. 33A-B, perspective views of a GFCI 100 incorporating the protective shutter assembly shown in FIG. 27 is disclosed. FIG. 33A is a cut-away view that removes the portion of the GFCI front cover that includes the receptacle openings (52, 53, 54). FIG. 33B is a perspective view of GFCI 100 without the cutaway view.

Figure 34:
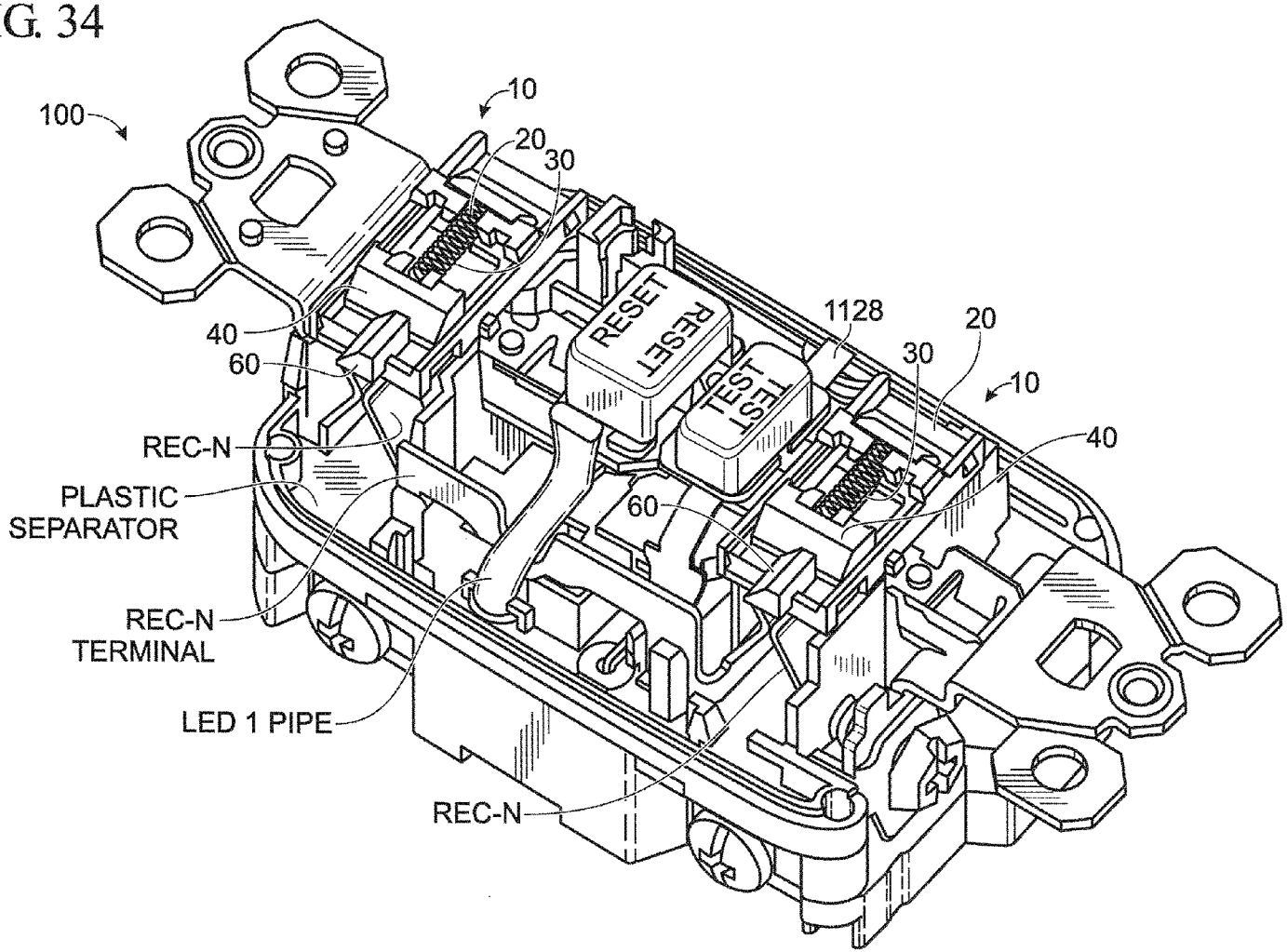
FIG. 34 is a perspective view of the GFCI depicted in FIGS. 31-33.

FIG. 34 is a perspective view of GFCI 100 with the front cover removed. Although the shutters 10 are shown in this view as being disposed over the insulating separator portion of the GFCI, they are in fact, disposed within the cover assembly in accordance with the manner previously described. However, the view presented in FIG. 34 illustrates the position of the shutter assembly over the receptacle contacts (e.g., REC N). In particular, the inner shutter member 40 is disposed over the neutral receptacle contacts (REC N) and the outer shutter 20 is disposed over the hot receptacle contacts (not shown in this view). The hot and neutral receptacle contact structures are configured to be disposed within the separator member. Each of the receptacle structures includes a fixed contact that is accessible to the circuit interrupting mechanism disposed under the separator.

Figure 35:
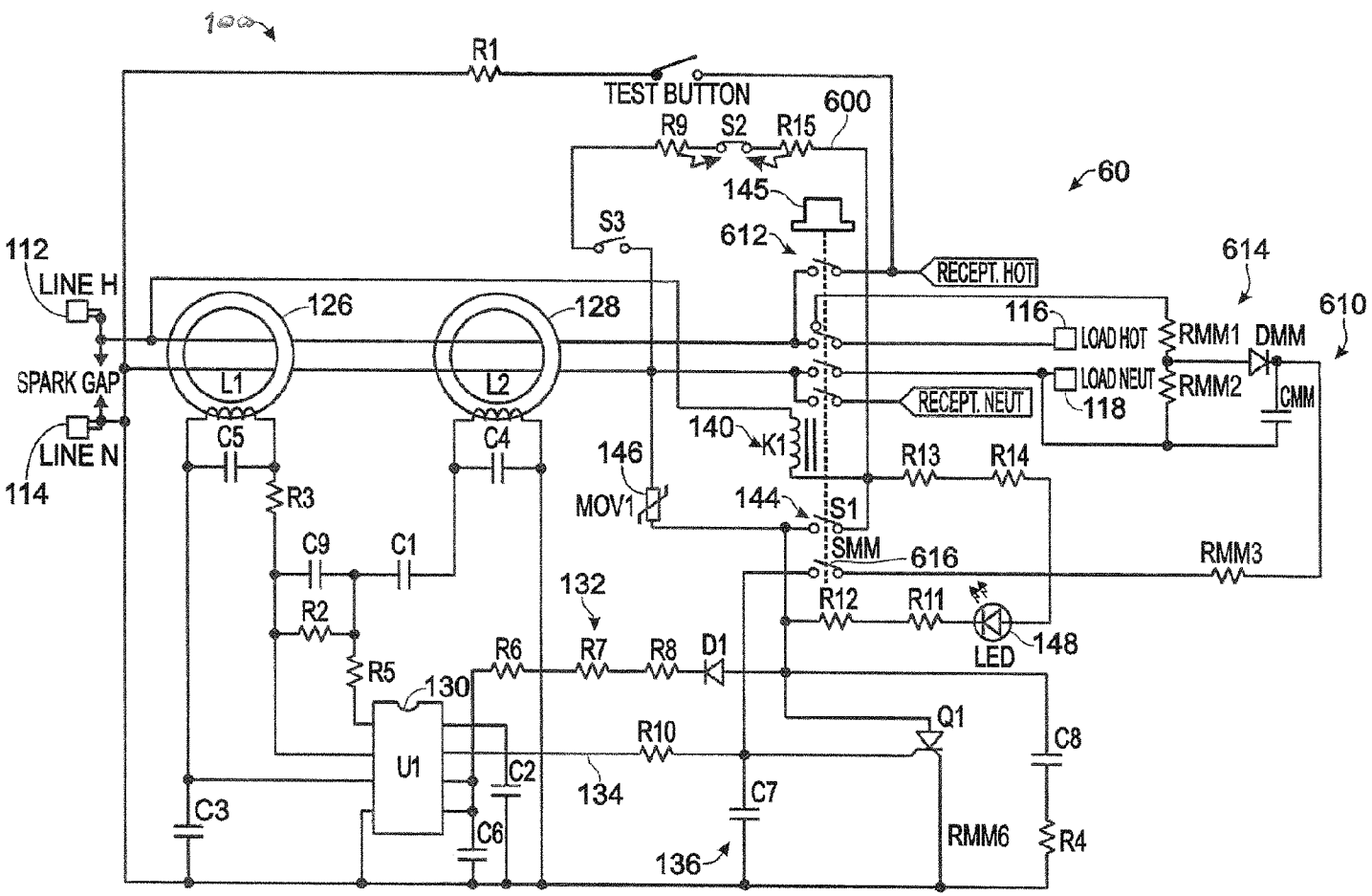
FIG. 35 is a schematic view of the GFCI depicted in FIGS. 31-34.

As embodied herein and depicted in FIG. 35, a schematic of the GFCI 100 depicted in FIGS. 31-34 is disclosed. Device 100 includes line terminals 112, 114, load terminals 116, 118, and receptacle terminals 117, 119. Load terminals 116, 118 may also be referred to herein as feed-through terminals. The load terminals 116, 118 may be connected to wiring that extends to electrical devices disposed downstream of device 100. Receptacle load terminals 117, 119 are configured to mate with one or more electrical plugs to provide power to a corded appliance or other such electrical loads. The line terminals 112, 114 are electrically connected to both load terminals 116, 118 and receptacle terminals 117,119 when circuit interrupter 124 is reset. When in the tripped state, the circuit interrupter 124 disconnects the load terminals from the line terminals. In addition, the circuit interrupter 124 may independently disconnect at least one feed-through terminal from a corresponding receptacle terminal.

The ground fault circuitry includes a differential transformer 126 which is configured to sense load-side ground faults. Transformer 128 is configured as a grounded neutral transmitter and is employed to sense grounded-neutral fault conditions. Both differential transformer 126 and grounded-neutral transformer 128 are coupled to detector circuit 130. Power supply 132 provides power for GFI detector circuit 130. Detector 130 provides an output signal on output pin 134 based on the transformer outputs. The detector output signal is filtered by circuit 136. The filtered output signal is provided to the control input of SCR Q1. When SCR Q1 is turned ON, solenoid 140 is energized to trip the circuit interrupter 124 and remove the fault condition. When this happens, the signal at the control input of the SCR Q1 turned OFF. The time that the solenoid 140 remains energized is less than about 25 milliseconds. After the fault condition has been eliminated, circuit interrupter 124 may be reset by way of reset button 145.

The present invention addresses certain end of life conditions by denying power to the load terminals when the protective device is unable to function. One end of life condition may cause the solenoid to be energized when a fault condition is not present, or if the circuit interrupter is in a tripped state.

The solenoid is susceptible to burn-out if it is permanently ON. One way that this can happen is if SCR 138 is permanently ON. Another way is if SCR 138 has shorted out. Note that most solenoids are configured to be energized only momentarily and burn out if energized for more than about 1 second. Once the solenoid burns out, the circuit interrupter is incapable of being tripped. As a result, the load terminals are permanently connected to the line terminals even when there is a fault condition. Solenoid burn-out may be prevented by an auxiliary switch 144. Auxiliary switch 144 is configured to open when circuit interrupter 124 is in the tripped position. If SCR 38 is shorted, or is permanently ON, auxiliary switch 144 ensures that solenoid 140 is not permanently connected to a current source. For example, if reset button 145 is activated, circuit interrupter 124 resets but immediately trips in response to the trip mechanism 142, which in turn moves auxiliary switch 144 to the open position before solenoid 140 is able to burn out. This sequence will repeat ad infinitum.

The auxiliary switch 144 affords other electrical benefits. Those of ordinary skill in the art will understand that a metal oxide varistor (MOV) is frequently employed in protective devices to protect the electrical circuit from voltage surges that sometimes occur in the electrical distribution system. The end-of-life failure mode of a MOV is typically an electrical short. The resulting current can be enough to thermally damage the enclosure of the protective device. Therefore, in one embodiment of the present invention, MOV 146 is connected in series with auxiliary switch 144 and trip solenoid 140 to eliminate any over-current situation. Thus, when MOV 146 reaches end of life and shorts out, trip solenoid 140 is energized to open auxiliary switch 140 and the flow of short circuit current is terminated before any damage ensues.

Another beneficial feature of the present invention is provided by disposing indicator 148 in parallel with auxiliary switch 144. In this embodiment, indicator 148 is implemented as a trip indicator, emitting a visual and/or audible indicator signal when circuit interrupter 124 is in the tripped state, i.e., when the auxiliary switch 144 is open. Of course, indicator 148 provides no such signal when device 10 is in a reset state. Again, indicator 148 may include visual indication, audible indication or both. The indicator may also be configured to emit a repetitive signal (flashing or beeping). A visual indicator may be a flashing red indicator.

Device 10 includes a wiring state protection assembly 60 that includes wiring state protection circuit 600 and secondary wiring state protection circuit 610. Wiring state protection circuit 600 is similar to the circuits employed in FIGS. 1-9, and therefore, a description of this circuit is eliminated for sake of brevity.

The secondary wiring state detection circuit 610 includes an isolation switch 616 ($S_{MUM}$) that is open when the circuit interrupter contacts 124 are closed, and closed when the circuit interrupter contacts 124 are open. Switch 616 ($S_{MUM}$) works in conjunction with the circuit interrupter contacts 612. In other words, when the circuit interrupter contacts 612 are tripped, switch 616 ($S_{MUM}$) is open and when the circuit interrupter contacts 612 are in the reset state, switch 616 ($S_{MUM}$) is closed. Both the fault detection circuit 130 and isolation switch 616 are connected to the input of SCR Q1. Accordingly, detection circuit 610 actuates SCR Q1 in response to detecting a miswire condition.

Charging circuit 614 includes a resistor $R_{MUM}$1 connected to the switch contact 612. Resistor $R_{MUM}$1 is connected in series with resistor $R_{MUM}$2, which is disposed in parallel with diode $D_{MUM}$ and capacitor $C_{MUM}$. Resistor $R_{MUM}$3 is connected between the cathode of the diode $D_{MUM}$ and isolation switch 616. When the device 10 is reset and properly wired, such that a source of AC power is connected to the line terminals (112, 114), switch contact 612 is open and the charging circuit 614 is not able to charge because $R_{MUM}$1 is not connected to AC power. In the tripped state, $R_{MUM}$1 is also not connected to AC power because AC power is connected to the line terminals (112, 114) and the load terminals (116, 118), of course, are not powered.

If device 10 is miswired, in the tripped state and AC power is applied to the load terminals (116, 118), $R_{MUM}$1 is connected to AC power via the switch contact 612 and load hot terminal 116. Resistor $R_{MUM}$3 is open circuited by virtue of isolation switch 616 being open. Since the charge on capacitor $C_{MUM}$ is not bled by $R_{MUM}$3 it accumulates charge. When the user resets device 10, capacitor $C_{MUM}$ discharges through the closed isolation switch 616, actuating the control input of SCR Q1 to turn it ON. When SCR Q1 is ON, solenoid 140 is energized, the interrupting contacts 124 trip, and the charging of capacitor $C_{MUM}$ begins anew. The circuit interrupter 124 trips each time reset is attempted until either power is removed from the load terminals or the miswiring condition is corrected.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening.

The recitation of ranges of values herein are merely intended to serve as a shorthand method of referring individually to each separate value falling within the range, unless otherwise indicated herein, and each separate value is incorporated into the specification as if it were individually recited herein.

All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not impose a limitation on the scope of the invention unless otherwise claimed.

No language in the specification should be construed as indicating any non-claimed element as essential to the practice of the invention.

It will be apparent to those skilled in the art that various modifications and variations can be made to the present invention without departing from the spirit and scope of the invention. There is no intention to limit the invention to the specific form or forms disclosed, but on the contrary, the intention is to cover all modifications, alternative constructions, and equivalents falling within the spirit and scope of the invention, as defined in the appended claims. Thus, it is intended that the present invention cover the modifications and variations of this invention provided they come within the scope of the appended claims and their equivalents.

What is claimed is:

1. A protective shutter assembly for use within an electrical wiring device including a housing assembly, the housing assembly further including a cover assembly and a rear body member, the cover assembly including at least one set of receptacle openings configured to receive a corded plug blade set having a hot plug blade and a neutral plug blade, the protective shutter assembly comprising:

at least one shutter mechanism configured to be disposed within an interior portion of the cover assembly in alignment with the at least one set of receptacle openings, the at least one shutter mechanism including a first shutter member having a first blade engagement structure and at least one second shutter member having at least one second blade engagement structure, the at least one second shutter member also including a positioning tab coupled to a stationary alignment portion of the housing assembly in a locked state and decoupled from the stationary alignment portion in an unlocked state, the at least one second shutter member being slidably disposed within the first shutter member such that the first shutter member and the at least one second shutter member are movable relative to each other to drive the positioning tab from the locked state to the unlocked state when the first blade engagement structure and the second blade engagement structure are substantially simultaneously engaged by a set of plug blades to thereby enable the at least one second shutter mechanism to move from a closed position to an open position, the first shutter member and the at least one second shutter member not being movable relative to each other when the positioning tab is in the locked state;

a spring member coupled to the first shutter member and the at least one second shutter member within the shutter mechanism, the spring member being configured to bias the shutter mechanism in the closed position; and a plurality of registration elements disposed on the at least one shutter mechanism, the plurality of registration elements being configured to position and align the protective shutter assembly within the cover assembly.

2. The assembly of claim 1, wherein the at least one set of receptacle openings includes a plurality of receptacle openings and the at least one shutter mechanism includes a plurality of shutter mechanisms, each of the plurality of shutter mechanisms being configured to be disposed within the interior portion of the cover assembly in alignment with a corresponding one of the plurality of receptacle openings.

3. The assembly of claim 1, wherein the at least one second shutter member includes a second shutter member and a third shutter member coupled to the first shutter member, the third shutter member being configured to engage a neutral blade of a 20 Ampere plug set.

4. The assembly of claim 3, wherein the positioning tab is an integral portion of the third shutter member.

5. The assembly of claim 3, wherein the second shutter member includes a cammed portion and the third shutter member includes a tooth portion, the cammed portion being configured to engage the tooth portion when the first shutter member and the second shutter member move relative to each other, the third shutter being moved relative to the first shutter member and the second shutter member to drive the positioning tab between the unlocked state and the locked state.

6. The assembly of claim 5, wherein the third shutter moves in a direction normal to the relative movement of the first shutter member and the second shutter member.

7. The assembly of claim 1, wherein the first blade engagement structure and the second blade engagement structure each include a plug blade detection structure disposed thereon, the plug blade detection structure being configured to engage a plug blade having predetermined characteristics and not engage objects not having the predetermined characteristics.

8. The assembly of claim 7, wherein the blade detection structure only permits the shutter mechanism to open if the width of an inserted object is greater than a predetermined amount.

9. An electrical wiring device comprising:

a housing assembly including a cover assembly, a rear body member, a plurality of line terminals and a plurality of load terminals, the cover assembly including at least one set of receptacle openings including a hot plug blade opening and a neutral plug blade opening having a vertical opening portion and a horizontal opening portion, the at least one set of receptacle openings configured to receive a corded plug blade set;

an electrical circuit assembly disposed within the housing assembly and coupled to the plurality of line terminals and the plurality of load terminals, the electrical circuit assembly including at least one set of receptacle contacts in operative alignment with the at least one set of receptacle openings; and at least one shutter mechanism configured to be disposed within an interior portion of the cover assembly and disposed between the at least one set of receptacle openings and the at least one set of receptacle contacts, the at least one shutter mechanism including, a first shutter member including a first blade engagement structure, a second shutter member including a second blade engagement structure, the second shutter member being slidably disposed within the first shutter member, a third shutter member having a third blade engagement structure, the third shutter member being slidably disposed within the first shutter member and coupled to the first shutter and the second shutter, the third shutter member including a locked state and an unlocked state, the third shutter being configured to be driven to the unlocked state and open only when the first shutter member and the second shutter member move relative to each other in response to the first blade engagement structure and the second blade engagement structure being substantially simultaneously engaged by a set of plug blades.

10. The device of claim 9, wherein the third shutter member includes a positioning tab coupled to a stationary alignment portion of the housing assembly in the unlocked state and decoupled from the stationary alignment portion in the locked state.

11. The device of claim 10, wherein the positioning tab is an integral portion of the third shutter member.

12. The device of claim 10, wherein the second shutter member includes a cammed portion and the third shutter member includes a tooth portion, the cammed portion being configured to engage the tooth portion when the first shutter member and the second shutter member move relative to each other, the third shutter being moved relative to the first shutter member and the second shutter member to drive the positioning tab between the unlocked state and the locked state.

13. The device of claim 12, wherein the third shutter member moves in a direction normal to the relative movement of the first shutter member and the second shutter member.

14. The device of claim 10, wherein the third shutter member is configured to engage a 20 A plug set.

15. The device of claim 9, wherein the first shutter member and the second shutter member are movable relative to each other from a closed position to an open position when the positioning tab is in the locked state.

16. The device of claim 9, wherein the first shutter member includes a first retainer portion and the second shutter member includes a second retainer portion, and wherein the at least one shutter mechanism further comprises a spring member including a first end disposed within the first retainer and a second end disposed within the second retainer, the spring member being configured to bias the at least one shutter mechanism in the closed position.

17. The device of claim 16, wherein the spring member includes only a single spring member, the single spring member being sufficient to bias the at least one shutter mechanism in the closed position.

18. The device of claim 9, wherein the at least one shutter mechanism further comprises a plurality of registration elements disposed on the at least one shutter mechanism, the plurality of registration elements being configured to position and align the at least one shutter mechanism within the cover assembly.

19. The device of claim 9, wherein the at least one set of receptacle openings includes a plurality of receptacle openings and the at least one shutter mechanism includes a plurality of shutter mechanisms, each of the plurality of shutter mechanisms being configured to be disposed within an interior portion of the cover assembly in alignment with a corresponding one of the plurality of receptacle openings.

20. The device of claim 9, wherein the housing assembly is configured as a wall mounted housing assembly, a power strip, an adapter, an extension cord or a raceway structure.

21. The device of claim 9, wherein the electrical circuit assembly further comprises:

a fault detection circuit coupled to the plurality of line terminals and configured to generate a fault detection signal in response to detecting at least one fault condition; and a circuit interrupter assembly coupled to the fault detection circuit, the circuit interrupter including a set of interrupting contacts configured to provide electrical continuity at least between the plurality of line terminals and the plurality of load terminals in a reset state, the set of interrupting contacts being decoupled in a tripped state to interrupt the electrical continuity in response to the fault detection signal.

22. The device of claim 9, wherein the electrical circuit assembly further comprises:

a detection assembly coupled to the plurality of line terminals and the plurality of load terminals, the detection assembly being configured to detect a wiring state associated with the plurality of line terminals and the plurality of load terminals, the detection assembly including at least one wiring state detection circuit; and a circuit interrupting assembly including four sets of interrupting contacts that are configured to provide electrical continuity between the plurality of line terminals and the plurality of load terminals in a reset state and configured to interrupt the electrical continuity in a tripped state, the circuit interrupting assembly being substantially prevented from effecting the reset state absent a predetermined successful proper installation signal from the at least one wiring state detection circuit.

23. The device of claim 22, wherein the at least one wiring state detection circuit is configured to self-disable after the predetermined successful proper installation signal.

24. The device of claim 22, wherein the at least one wiring state detection circuit is coupled to the plurality of line terminals and the secondary wiring state detection circuit is coupled to the plurality of load terminals.

25. The device of claim 9, wherein the electrical circuit assembly further comprises:

a detection assembly configured to detect a wiring state associated with the plurality of line terminals and the plurality of load terminals, the detection assembly including a first wiring state detection circuit configured to respond to a miswire condition occurring during an initial device installation sequence but not during any subsequent device installation sequence, each installation sequence concluding with AC power being applied to the plurality of line terminals, the detection assembly including a second wiring state detection circuit configured to respond to a miswire condition occurring during a subsequent installation sequence, each installation sequence concluding with AC power being applied to the plurality of line terminals; and a circuit interrupting assembly including interrupting contacts that are configured to provide electrical continuity between the line terminals and the load terminals in a reset state and configured to interrupt the electrical continuity in tripped state, the circuit interrupting assembly being configured to trip in response to a predetermined signal from the first wiring state detection circuit.

26. The device of claim 25, wherein the primary wiring state detection circuit includes a fusible element.

27. The device of claim 25, wherein detection assembly is configured to substantially prevent the circuit interrupting assembly from effecting the reset state upon detecting the miswired condition without using a mechanical barrier.

28. The device of claim 25, wherein the response of the second wiring state detection circuit to a miswired condition includes a visible indicia.

29. The device of claim 28, wherein the visible indicia is the failure of an indicator to illuminate when the circuit interrupter is in the tripped state.

30. The device of claim 25, wherein the detection assembly further includes a fault detection circuit, the fault detection circuit being responsive to a fault condition in the electrical distribution system or a miswire condition detected by either the primary wiring state detection circuit or the second wiring state detection circuit, the response including the generation of a trip signal that places the circuit interrupting assembly in the tripped state.

31. The device of claim 30, further comprising a low pass filter configured to substantially filter transient voltage surges propagating in the electrical distribution system.

32. The device of claim 30, further comprising a differentially connected MOV configured to substantially prevent transient voltage surges propagating in the electrical distribution system from damaging the detection assembly.

33. The device of claim 30, wherein the fault detection circuit includes an end of life detection circuit for detecting at least one end of life condition.

34. The device of claim 25, wherein the detection assembly includes an electronic switching component having a control input operatively coupled to an output of the primary wiring state detection circuit or the second wiring state detection circuit, the electronic switching component being configured to drive the circuit interrupting assembly into the tripped state.

35. A modular shutter assembly for use within various types of electrical wiring devices having differing amperage ratings, each of the electrical wiring devices including a housing assembly, the housing assembly further including a cover assembly and a rear body member, the cover assembly including at least one set of receptacle openings configured to receive a corded plug blade set having a hot plug blade and a neutral plug blade, the modular shutter assembly comprising:

a first shutter member including a first blade engagement structure, the first shutter member being configured to be disposed within an interior portion of the cover assembly and disposed between the at least one set of receptacle openings and the at least one set of receptacle contacts;

a second shutter member including a second blade engagement structure, the second shutter member being slidably disposed within the first shutter member;

an interface formed in either the first shutter member or the second shutter member or both, the interface being configured to connect a third shutter member to the modular shutter assembly, the interface being configured to drive the third shutter into an open position only when the first shutter member and the second shutter member move relative to each other in response to the first blade engagement structure and the second blade engagement structure being substantially simultaneously engaged by a set of plug blades, the interface not interfering with the operation of the first shutter member and the second shutter member when the modular shutter assembly is used without the third shutter member.

36. The assembly of claim 35, wherein the third shutter member is configured to be slidably disposed within the first shutter member.

37. The assembly of claim 35, wherein the third shutter member is configured to implement a locked state and an unlocked state in the modular shutter assembly, the third shutter being configured to be driven to an unlocked state and open only when the first shutter member and the second shutter member move relative to each other in response to the first blade engagement structure and the second blade engagement structure being substantially simultaneously engaged by a set of plug blades.

38. The assembly of claim 35, wherein the third shutter member includes a positioning tab coupled to a stationary alignment portion of the housing assembly in the unlocked state and decoupled from the stationary alignment portion in the locked state.

39. The assembly of claim 38, wherein the interface includes a cammed portion formed in the second shutter member and a tooth portion formed in the third shutter member, the cammed portion being configured to engage the tooth portion when the first shutter member and the second shutter member move relative to each other, the third shutter being moved relative to the first shutter member and the second shutter member to drive the positioning tab between the unlocked state and the locked state.

40. The assembly of claim 39, wherein the cammed portion includes a non-linear camming surface.

41. The assembly of claim 40, wherein the cammed portion includes a camming surface comprising two substantially linear segments having different slopes.

42. The assembly of claim 38, wherein the third shutter moves in a direction normal to the relative movement of the first shutter member and the second shutter member.

43. The assembly of claim 35, wherein the first blade engagement structure and the second blade engagement structure each include a plug blade detection structure disposed thereon, the plug blade detection structure being configured to engage a plug blade having predetermined characteristics and not engage objects not having the predetermined characteristics.

44. The assembly of claim 43, wherein the blade detection structure only permits the shutter mechanism to open if the width of an inserted object is greater than a predetermined amount.

45. The assembly of claim 35, further comprising a plurality of shutter registration elements disposed on the first shutter member or the second shutter member, the plurality of shutter registration elements being configured to position and align the protective shutter assembly within the cover assembly.

46. The assembly of claim 35, wherein the cover assembly is configured to accommodate the third shutter of the at least one modular shutter assembly while one of the sets of receptacle openings is configured to prevent a neutral plug blade from having access to the third shutter.

47. The assembly of claim 35, further including an attachment structure configured to couple the third shutter to the first shutter.

48. The assembly of claim 47, wherein the attachment structure includes a tab configured to be coupled to a mating slot.

49. The assembly of claim 35, wherein the third shutter member includes a locking member configured to mate with a locking rail portion disposed on a rail of the first shutter member, the locking member including a locking tab configured to mate with the locking rail portion in an engaged state, the locking member further including a guideway configured to slidably couple to the rail such that the locking member is configured to slidably move between the engaged state and a disengaged state.

50. The assembly of claim 49, wherein the guideway is configured to couple to the rail by a snap-fit mechanism.

* * * * *